US008877414B2

(12) United States Patent
Sugawara et al.

(10) Patent No.: US 8,877,414 B2
(45) Date of Patent: Nov. 4, 2014

(54) ELECTROSTATIC IMAGE DEVELOPING TONER, METHOD FOR MANUFACTURING ELECTROSTATIC IMAGE DEVELOPING TONER, DEVELOPER, AND IMAGE FORMING METHOD

(75) Inventors: Atsushi Sugawara, Kanagawa (JP); Shinpei Takagi, Kanagawa (JP); Atsushi Sugitate, Kanagawa (JP); Daisuke Noguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 468 days.

(21) Appl. No.: 13/032,295

(22) Filed: Feb. 22, 2011

(65) Prior Publication Data

US 2012/0070772 A1 Mar. 22, 2012

(30) Foreign Application Priority Data

Sep. 21, 2010 (JP) ..... 2010-211392

(51) Int. Cl.

| | |
|---|---|
| ***G03G 9/08*** | (2006.01) |
| ***G03G 9/107*** | (2006.01) |
| ***G03G 9/113*** | (2006.01) |
| ***G03G 9/087*** | (2006.01) |
| ***G03G 9/097*** | (2006.01) |

(52) U.S. Cl.

CPC ..... *G03G 9/0819* (2013.01); *G03G 9/107* (2013.01); *G03G 9/1139* (2013.01); *G03G 9/08726* (2013.01); *G03G 9/09733* (2013.01); *G03G 9/1135* (2013.01); *G03G 9/08711* (2013.01); *G03G 9/08795* (2013.01); *G03G 9/097* (2013.01); *G03G 9/08755* (2013.01); *G03G 9/1131* (2013.01); *G03G 9/08797* (2013.01); *G03G 9/08722* (2013.01)

USPC ..... 430/108.1; 430/109.4; 430/110.2; 430/137.14; 430/108.2

(58) Field of Classification Search

CPC ..... G03G 9/0819; G03G 9/08726; G03G 9/08755; G03G 9/1131; G03G 9/1139

USPC ..... 430/108.2–108.7, 110.2–110.3, 108.1, 430/108.9, 109.3, 109.4, 137.14

See application file for complete search history.

(56) References Cited

U.S. PATENT DOCUMENTS

| | | | | |
|---|---|---|---|---|
| 2005/0136354 | A1* | 6/2005 | Ueda et al. | 430/110.2 |
| 2007/0141500 | A1* | 6/2007 | Sugimoto et al. | 430/110.3 |

(Continued)

FOREIGN PATENT DOCUMENTS

| | | |
|---|---|---|
| JP | A-H9-281741 | 10/1997 |
| JP | A-2004-246344 | 9/2004 |

(Continued)

OTHER PUBLICATIONS

Mar. 4, 2014 Office Action issued in Japanese Application No. 2010-211392 (with English Translation).

(Continued)

*Primary Examiner* — Mark F Huff
*Assistant Examiner* — Rashid Alam
(74) *Attorney, Agent, or Firm* — Oliff PLC

(57) ABSTRACT

An electrostatic image developing toner including: a toner matrix particle having an adhering particle adhered onto the surface of a central particle, wherein a volume average value of a ratio X of a peripheral length PM to a circle-corresponding diameter D is from 3.6 to 5.0.

18 Claims, 2 Drawing Sheets

(56) References Cited

U.S. PATENT DOCUMENTS

| | | | | |
|---|---|---|---|---|
| 2007/0237555 | A1* | 10/2007 | Kikuchi et al. | 399/333 |
| 2008/0233496 | A1 | 9/2008 | Kotsugai et al. | |
| 2008/0305423 | A1* | 12/2008 | Sugiura et al. | 430/109.4 |
| 2009/0081573 | A1* | 3/2009 | Iwazaki et al. | 430/108.7 |
| 2009/0130589 | A1 | 5/2009 | Udo et al. | |
| 2009/0233203 | A1* | 9/2009 | Yuasa et al. | 430/108.4 |
| 2011/0065036 | A1* | 3/2011 | Inoue et al. | 430/108.2 |

FOREIGN PATENT DOCUMENTS

| | | |
|---|---|---|
| JP | A-2005-274964 | 10/2005 |
| JP | A-2008-158319 | 7/2008 |
| JP | A-2008-233430 | 10/2008 |
| JP | A-2008-241776 | 10/2008 |
| JP | A-2008-268872 | 11/2008 |
| JP | A-2009-122673 | 6/2009 |
| JP | A-2010-019890 | 1/2010 |
| JP | A-2010-282206 | 12/2010 |
| JP | A-2011-128410 | 6/2011 |

OTHER PUBLICATIONS

Apr. 28, 2014 Notification of Information Offer issued in Japanese Application No. 2010-211392 (with English Translation).

* cited by examiner

ELECTROSTATIC IMAGE DEVELOPING TONER, METHOD FOR MANUFACTURING ELECTROSTATIC IMAGE DEVELOPING TONER, DEVELOPER, AND IMAGE FORMING METHOD

CROSS-REFERENCE TO RELATED APPLICATION(S)

The present application claims priority from Japanese Patent Application No. 2010-211392 filed on Sep. 21, 2010, the entire content of which is incorporated herein by reference.

BACKGROUND

1. Field

The present invention relates to an electrostatic image developing toner, a method for manufacturing electrostatic image developing toner, a developer and an image forming method.

2. Description of the Related Art

The image formation in an electrophotographic process is a method in which at copying, a toner is adhered to an electrostatic latent image formed on a photoreceptor made of a photoconductive substance and developed as a toner image by a magnetic brush developing method or the like, the toner image on the photoreceptor is transferred onto a recording material (transfer material) such as papers and sheets, and the transferred toner image is then fixed utilizing heat, a solvent, a pressure or the like to obtain a permanent image.

In this image formation using a toner, maintenance of transfer efficiency of the toner image and cleaning properties of the residual toner are important.

SUMMARY

An electrostatic image developing toner including: a toner matrix particle having an adhering particle adhered onto the surface of a central particle, wherein a volume average value of a ratio X of a peripheral length PM to a circle-corresponding diameter D is from 3.6 to 5.0.

DETAILED DESCRIPTION OF EXEMPLARY EMBODIMENTS

Present exemplary embodiments are hereunder described.

(Electrostatic Image Developing Toner)

The electrostatic image developing toner according to the present exemplary embodiment (hereinafter sometimes referred to simply as a "toner") is a toner matrix particle in which another particle is adhered onto the surface of a central particle and which is characterized in that a volume average value of a ratio X of peripheral length (PM)/circle-corresponding diameter (D) is 3.6 or more and not more than 5.0 (from 3.6 to 5.0).

In the present exemplary embodiment, the terms "from A to B" express not only a range between A and B but a range including A and B, each of which is an end thereof. For example, so far as the terms "from A to B" are concerned with a numerical value range, they express "A or more and not more than B" or "B or more and not more than A".

As for the measurement method of X, X is calculated by observing a toner particle in an external additive-free state by an electron microscope and subjecting it to image processing. Also, the volume average value is one obtained by determining an average value regarding 50 toner particles. A method for separating external additive-free toner matrix particles from toners in which an external additive coexists is described in the working examples.

When the X value is less than 3.6, irregularities on the toner particle surface are few, and there is seen a tendency that the transfer efficiency and cleaning properties are inferior; whereas when the X value exceeds 5.0, the number of adhering particles increases, the particle shape becomes instable, and there is seen a tendency that the transfer efficiency and cleaning properties are inferior.

Furthermore, when an external additive is used on the toner surface, since irregularities on the toner particle surface are many, the external additive is easily embedded in the irregularities, and contribution of effects by the external additive becomes disappeared. For that reason, designing of a developer is easy to become difficult.

Figure 1:
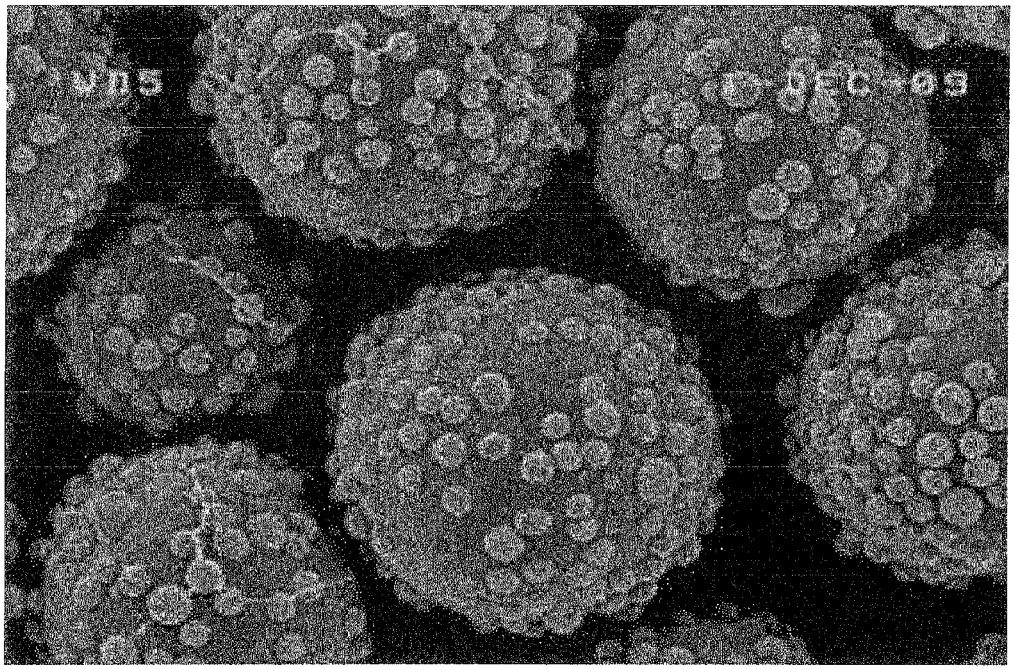
FIG. 1 is an electron microscopic photograph showing an example of an electrostatic image developing toner according to a present exemplary embodiment.

FIG. 1 is an electron microscopic photograph showing an example of the electrostatic image developing toner according to the present exemplary embodiment.

As shown in FIG. 1, the electrostatic image developing toner according to the present exemplary embodiment contains a toner matrix particle in which another particle is adhered onto the surface of a central particle. A circle-corresponding diameter of the toner matrix particle is preferably from 2 μm to 8 μm, and more preferably from 3 μm to 7 μm. A particle diameter of the particle (adhering particle) that is adhered onto the surface of this toner matrix particle is preferably from 100 nm to 500 nm, and more preferably from 200 nm to 500 nm in terms of a volume average.

Materials of the central particle and the adhering particle, and so on are described later.

Toner constituent materials which are used in the present exemplary embodiment, toner manufacturing method and so on are hereunder described.

<Binder Resin>

As for the toner according to the present exemplary embodiment, the central particle contains at least a binder resin. The binder resin is not particularly limited, and examples thereof include an addition polymerization based resin and a polycondensation based resin. Of these, the addition polymerization based resin is preferably an addition polymerization resin of an ethylenically unsaturated compound, and more preferably an acrylic resin; and the polycondensation based resin is preferably a polyester resin, and more preferably a polyester of a polyol and a polycarboxylic acid.

As the addition polymerization based resin, various homopolymers or copolymers of an ethylenically unsaturated compound are preferably used. Examples of the addition polymerization resin of an ethylenically unsaturated compound include homopolymers or copolymers of a styrene (for example, styrene, chlorostyrene, etc.), a monoolefin (for example, ethylene, propylene, butylene, isoprene, etc.), a vinyl ester (for example, vinyl acetate, vinyl propionate, vinyl benzoate, etc.), an α-methylene aliphatic monocarboxylic acid ester (for example, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.), a vinyl ether (for example, vinyl methyl ether, vinyl ethyl ether, vinyl butyl ether, etc.), a vinyl ketone (for example, vinyl methyl ketone, vinyl hexyl ketone, vinyl isopropenyl ketone, etc.) or the like.

Examples of the addition polymerization based resin which is especially preferably used include a polystyrene, a styrene-alkyl acrylate copolymer and a styrene-alkyl methacrylate copolymer.

As the polycondensation based resin which is used in the present exemplary embodiment, a polyester resin can be exemplified, and it is synthesized from a polyol component and a polycarboxylic acid component. In the present exemplary embodiment, as the polyester resin, a commercially available material may be used, or a properly synthesized material may be used.

Examples of the polyvalent carboxylic acid component include dibasic acids such as aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid, etc.); and aromatic dicarboxylic acids (for example, phthalic acid, isophthalic acid, terephthalic acid, naphthalene-2,6-dicarboxylic acid, malonic acid, mesaconic acid, etc.). In addition, anhydrides or lower alkyl esters of the foregoing dibasic acids are also exemplified.

Examples of trivalent or higher valent carboxylic acids include 1,2,4-benzenetricarboxylic acid, 1,2,5-benzenetricarboxylic acid, 1,2,4-naphthalenetricarboxylic acid, and anhydrides or lower alkyl esters thereof. These materials may be used singly or in combinations of two or more kinds thereof.

Furthermore, in addition to the foregoing aliphatic dicarboxylic acids or aromatic dicarboxylic acids, it is more preferable that a dicarboxylic acid having an ethylenically unsaturated bond is contained. The dicarboxylic acid having an ethylenically unsaturated bond achieves radical crosslinking via an ethylenically unsaturated bond, so that it is suitably used for the purpose of preventing hot offset at the time of fixing. Examples of such a dicarboxylic acid include maleic acid, fumaric acid, 3-hexenedioic acid and 3-octenedioic acid. However, such a dicarboxylic acid is not limited thereto. Also, lower alkyl esters or anhydrides thereof are exemplified. Of these, in view of costs, fumaric acid, maleic acid or the like is preferable.

As for the polyhydric alcohol component, examples of a dihydric alcohol include alkylene (carbon number: 2 to 4) oxide adducts of bisphenol A (average addition molar number: 1.5 to 6) such as polyoxypropylene (2,2)-2,2-bis(4-hydroxyphenyl)propane and polyoxyethylene (2,2)-2,2-bis(4-hydroxyphenyl)propane, ethylene glycol, propylene glycol, neopentyl glycol, 1,4-butanediol, 1,3-butanediol and 1,6-hexanediol.

Examples of a trihydric or higher hydric alcohol include sorbitol, pentaerythritol, glycerol and trimethylolpropane.

As for an amorphous polyester resin (sometimes referred to as a "non-crystalline polyester resin"), among the foregoing raw material monomers, dihydric or higher hydric secondary alcohols and/or divalent or higher valent aromatic carboxylic acid compounds are preferable. Examples of the dihydric or higher hydric secondary alcohol include a propylene oxide adduct of bisphenol A, propylene glycol, 1,3-butanediol and glycerol. Of these, a propylene oxide adduct of bisphenol A is preferable.

As the divalent or higher valent aromatic carboxylic acid compound, terephthalic acid, isophthalic acid, phthalic acid or trimellitic acid is preferable, and terephthalic acid or trimellitic acid is more preferable.

Also, a resin having a softening temperature of from 90° C. to 150° C., a glass transition temperature of from 50° C. to 75° C., a number average molecular weight of from 2,000 to 10,000, a weight average molecular weight of from 8,000 to 150,000, an acid number of from 5 mg-KOH/g to 30 mg-KOH/g and a hydroxyl number of from 5 mg-KOH/g to 40 mg-KOH/g is especially preferably used.

Also, for the purpose of imparting low-temperature fixability to the toner, it is preferable to use a crystalline polyester resin in at least a part of the binder resin.

The crystalline polyester resin is preferably constituted of an aliphatic dicarboxylic acid and an aliphatic diol, and more preferably constituted of a straight chain type dicarboxylic acid and a straight chain type aliphatic diol, in each of which a carbon number in a main chain segment thereof is from 4 to 20. In the case of a straight chain type, because of excellent crystallinity and appropriate crystal melting temperature of the polyester resin, excellent toner blocking resistance, image storage stability and low-temperature fixability are revealed. Also, in the case of a carbon number of 4 or more, the polyester resin is low in ester bond concentration, adequate in electrical resistance and excellent in toner chargeability. Also, in the case of a carbon number of not more than 20, practically useful materials are easily available. The carbon number is more preferably not more than 14.

Examples of the aliphatic dicarboxylic acid which is suitably used for the synthesis of the crystalline polyester include oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, and lower alkyl esters or acid anhydrides thereof. However, it should not be construed that the invention is limited thereto. Of these, taking into consideration easiness of availability, sebacic acid or 1,10-decanedixaboxylic acid is preferable.

Specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. However, it should not be construed that the invention is limited thereto. Of these, taking into consideration easiness of availability, 1,8-octanediol, 1,9-nonanediol or 1,10-decanediol is preferable.

Examples of the trihydric or higher hydric alcohol include glycerin, trimethylolethane, trimethylolpropane and pentaerythritol. These materials may be used singly or in combinations of two or more kinds thereof.

A content of the aliphatic dicarboxylic acid in the polyvalent carboxylic acid is preferably 80% by mole or more, and more preferably 90% by mole or more. When the content of the aliphatic dicarboxylic acid is 80% by mole or more, because of excellent crystallinity and adequate melting temperature of the polyester resin, excellent toner blocking resistance, image storability and low-temperature fixability are revealed.

A content of the aliphatic diol in the polyhydric alcohol component is preferably 80% by mole or more, and more preferably 90% by mole or more. When the content of the aliphatic diol is 80% by mole or more, because of excellent crystallinity and adequate melting temperature of the polyester resin, excellent toner blocking resistance, image storability and low-temperature fixability are revealed.

If desired, for the purpose of, for example, adjusting the acid number or hydroxyl number, a monovalent acid such as acetic acid and benzoic acid, or a monohydric alcohol such as cyclohexanol and benzyl alcohol, is also useful.

A manufacturing method of the polyester resin is not particularly limited, and the polyester resin can be manufactured by a general polyester polymerization method for allowing an acid component and an alcohol compound to react with each other. Examples thereof include a direct polycondensation method and an ester interchange method. The polyester resin is manufactured depending upon the kinds of the monomers.

The polyester resin may be manufactured by subjecting the foregoing polyhydric alcohol and polyvalent carboxylic acid to a condensation reaction in the usual way. For example, the polyester resin is manufactured by charging and blending the foregoing polyhydric alcohol and polyvalent carboxylic acid and optionally, a catalyst in a reactor equipped with a thermometer, a stirrer and a flow-down type condenser; heating the mixture at from 150° C. to 250° C. in the presence of an inert gas (for example, a nitrogen gas, etc.), thereby continuously removing a low-molecular weight compound produced as a by-product out the reaction system; and stopping the reaction at a point of time of reaching a prescribed acid number, followed by cooling to obtain a desired reaction product.

Also, though a content of the binder resin in the toner according to the present exemplary embodiment is not particularly limited, it is preferably from 5% by weight to 95% by weight, more preferably from 20% by weight to 90% by weight, and still more preferably from 40% by weight to 85% by weight on the basis of the total weight of the electrostatic image developing toner. When the content of the binder resin falls within the foregoing ranges, excellent fixability, storage properties, powder characteristics and charge characteristics are revealed.

<Release Agent>

The toner according to the present exemplary embodiment contains at least a release agent. It is preferable that the release agent is incorporated into the central particle.

The release agent which is used in the present exemplary embodiment is not particularly limited, known materials are useful, and those obtained from the following waxes are preferable. That is, examples of useful waxes include a paraffin wax and derivatives thereof, a montan wax and derivatives thereof, a microcrystalline wax and derivatives thereof, a Fischer-Tropsch wax and derivatives thereof, and a polyolefin wax and derivatives thereof. The "derivatives" as referred to herein include an oxide, a polymer with a vinyl monomer, and a graft modified product. Besides, alcohols, fatty acids, plant waxes, animal waxes, mineral waxes, ester waxes, acid amides and so on are also useful.

It is preferable that the wax which is used as the release agent is melted at any temperature of from 70° C. to 140° C. and has a melt viscosity of from 1 centipoise to 200 centipoises. It is more preferable that the wax has a melt viscosity of from 1 centipoise to 100 centipoises. When the temperature at which the wax is melted is 70° C. or higher, the temperature at which the wax varies is sufficiently high, and excellent blocking resistance and developability when the temperature within a copier increases are revealed. When the temperature at which the wax is melted is not higher than 140° C., the temperature at which the wax varies is sufficiently low, it is not necessary to perform fixing at high temperatures, and excellent energy saving is revealed. Also, when the melt viscosity of the wax is not more than 200 centipoises, elution of the wax from the toner is adequate, and excellent fixing releasability is revealed.

Also, a content of the release agent is preferably from 3% by weight to 60% by weight, more preferably from 5% by weight to 40% by weight, and still more preferably from 7% by weight to 20% by weight on the basis of the total weight of the toner. When the content of the release agent falls within the foregoing ranges, not only more excellent toner offset-preventing properties onto a heating member are revealed, but more excellent feed roll contamination-preventing properties are revealed.

<Coloring Agent>

It is preferable that the toner according to the present exemplary embodiment contains a coloring agent. It is preferable that the coloring agent is incorporated into the central particle.

Representative examples of the coloring agent include carbon black, nigrosine, Aniline Blue, Chalcoyl Blue, Chromium Yellow, Ultramarine Blue, Du Pont Oil Red, Quinoline Yellow, Methylene Blue Chloride, Phthalocyanine Blue, Malachite Green Oxalate, lamp black, rose bengal, C.I. Pigment Red 48:1, C.I. Pigment Red 122, C.I. Pigment 57:1, C.I. Pigment Red 238, C.I. Pigment Yellow 97, C.I. Pigment Yellow 12, C.I. Pigment Yellow 180, C.I. Pigment Blue 15:1 and C.I. Pigment Blue 15:3.

The coloring agent is used singly or in combinations of two or more kinds thereof.

In the toner according to the present exemplary embodiment, the coloring agent is chosen from the viewpoints of hue angle, color saturation, lightness, weather resistance, OHP transmissivity and dispersibility in the toner. Though an addition amount of the coloring agent is not particularly limited, it is suitably in the range of from 3% by weight to 60% by weight on the basis of the total weight of the toner.

<Other Toner Additives>

In addition to the foregoing components, various components such as an internal additive, a charge controlling agent, an inorganic powder (inorganic particle) and an organic particles may be added to the toner according to the present exemplary embodiment as the need arises.

Examples of the internal additive include magnetic materials metals or alloys such as ferrite, magnetite, reduced ion, cobalt, nickel and manganese; and compounds containing such metals.

Examples of the charge controlling agent include quaternary ammonium salt compounds, nigrosine based compounds, dyes composed of a complex of aluminum, iron, chromium, etc. and triphenylmethane based pigments.

Also, the inorganic powder is added mainly for the purpose of adjusting viscoelasticity of the toner, and examples thereof include all inorganic particles which are usually used as an external additive of toner and which are enumerated below in detail, such as silica, alumina, titania, calcium carbonate, magnesium carbonate, calcium phosphate and cerium oxide.

A volume average particle diameter of the toner matrix particle according to the present exemplary embodiment is preferably from 2 μm to 8 μm, and more preferably from 3 to 7 μm. When the volume average particle diameter of the toner matrix particle falls within the foregoing ranges, excellent chargeability, developability and image resolution are revealed.

Also, it is preferable that the toner matrix particle according to the present exemplary embodiment has a volume average particle size distribution index $GSD_v$ of not more than 1.28. When the volume average particle size distribution index $GSD_v$ of the toner matrix particle is not more than 1.28, excellent image resolution is revealed.

In the present exemplary embodiment, a particle diameter of the toner and the foregoing volume average particle size distribution index $GSD_v$ value are measured and calculated as follows. Cumulative distribution of the volume of each of the toner particles is drawn from the small diameter side with respect to the particle diameter range (channel) divided on the basis of the particle size distribution measured using a measuring device such as Coulter counter TAII (manufactured by Beckman Coulter Inc.) and Multisizer II (manufactured by Beckman Coulter Inc.), and the particle diameter at 16% accumulation is defined as $D_{16v}$ by volume, and the particle diameter at 50% accumulation is defined as $D_{50v}$ by volume. Similarly, the particle diameter at 84% accumulation is defined as $D_{84v}$ by volume. On that occasion, as for the volume average particle size distribution index $GSD_v$, the volume average particle size distribution index $GSD_v$ is calculated using a relational expression defined as $D_{84v}/D_{16v}$.

Also, a shape factor SF1 (=((absolute maximum length of toner diameter)$^2$/(projected area of toner))×(π/4)×100) of the toner matrix particle according to the present exemplary embodiment is preferably in the range of from 110 to 160, and more preferably in the range of from 110 to 140.

The value of the shape factor SF1 expresses roundness of the toner, and in the case of a true sphere, the shape factor SF1 is 100. As the shape of the toner becomes amorphous, the shape factor SF1 increases. Also, the values which become necessary at the calculation using the shape factor SF1, namely the absolute maximum length of the toner diameter and the projected area of the toner are determined by photographing a toner particle image enlarged with a magnification of 500 using an optical microscope (Microphoto-FXA, manufactured by Nikon Corporation), introducing the obtained image information into, for example, an image analyzer (Luzex III, manufactured by Nireco Corporation) via an interface and performing image analysis. An average value of the shape factor SF1 is calculated on the basis of data obtained by measuring 1,000 toner particles sampled at random.

When the shape factor SF1 is 110 or more, the generation of a residual toner in a transfer step at the image formation is suppressed, and excellent cleaning properties at cleaning using a blade or the like are revealed, resulting in suppressing image defects. Meanwhile, when the shape factor SF1 is not more than 160, in the case of using the toner as a developer, breakage of the toner to be caused due to a collision with a carrier within a developing device is prevented from occurring, resulting in suppressing the generation of a fine powder. According to this, contamination of the photoreceptor surface or the like with the release agent component exposed on the toner surface is prevented from occurring, whereby not only excellent charge characteristics are revealed, but, for example, the generation of a fog to be caused due to a fine powder is suppressed.

<Adhering Particle>

In the toner according to the present exemplary embodiment, as for the toner matrix particle in which another particle is adhered onto the surface of the central particle, in order that a volume average value of a ratio X of peripheral length (PM)/circle-corresponding diameter (D) may be from 3.6 to 5.0, a volume average value of a particle diameter of a particle (adhering particle) that is adhered onto the surface of the toner matrix particle is preferably from 100 nm to 500 nm.

Also, it is preferable that the adhering particle is an organic resin particle. The following description is made centering on the case where the adhering particle is an organic resin particle.

Examples of the organic resin particle which is used as the adhering particle include an addition polymerization based resin and a polycondensation based resin. Of these, the addition polymerization based resin is preferably an acrylic resin, and the polycondensation based resin is preferably a polyester resin. The acrylic resin particle is preferably one in which a monomer unit derived from a (meth)acrylic acid ester is a main monomer unit.

The organic resin particle which is used as the adhering particle may be the same as or different from the binder resin constituting an aggregated particle to be adhered in terms of a chemical composition.

In the present exemplary embodiment, though the organic resin particle which is preferably used as the adhering particle may be crosslinked or may not be crosslinked, it is preferable that the organic resin particle is not crosslinked.

The organic resin particle is fixed to the toner matrix particle. At this point, the organic resin particle is different from the external additive that is a fluidizing agent and which is not fixed to the toner matrix particle.

<Toner Shape>

As for the toner particle according to the present exemplary embodiment, a number average value of a proportion of a projected area of the adhering particle to a total projected area of the toner matrix particle by SEM observation is preferably from 20% to 80%, and more preferably from 30% to 60%.

Also, as for the toner particle according to the present exemplary embodiment, it is preferable that the adhering particle is embedded from the surface to the inside of the central particle only in a depth of less than a half of the diameter of the adhering particle; and it is more preferable that the adhering particle is embedded only in a depth of not more than ¼ of the diameter of the adhering particle. An embedding degree of the adhering particle can be discriminated by taking an electron microscopic photograph.

<Manufacturing Method of Electrostatic Image Developing Toner>

A manufacturing method of the toner according to the present exemplary embodiment includes an aggregating step of aggregating a liquid dispersion containing at least a binder resin and a coloring agent to form an aggregate; a particle adhering step of adhering a particle onto the surface of the aggregate; and a fusing step of fusing and coalescing the aggregate and the adhering particle.

In the aggregating step, it is preferable that a liquid dispersion containing a release agent particle in addition to the binder resin and the coloring agent is aggregated to form an aggregate.

The particle adhering step is preferably a step in which after a core particle forming step of forming a core particle of the toner, a shell layer is coated on the surface of the core particle, and thereafter, an adhering particle is adhered onto the outside of the core particle. It is preferable that after the coating step of a shell layer, an adhering particle of from 100 nm to 500 nm is added and adhered onto the core particle. In the case of simultaneously adding the both particles, the adhering particle is easily embedded in the core and shell layers, and the volume average value of the ratio X of peripheral length (PM)/circle-corresponding diameter (D) tends to be lowered. An addition amount of the adhering particle is preferably from 10% to 40%, and more preferably from 10% to 30% relative to the toner. By adding the adhering particle in an amount of 10% or more, the volume average value of the ratio X of peripheral length (PM)/circle-corresponding diameter (D) can be regulated to a prescribed value, and it is possible to make both transferability and cleaning properties compatible with each other. Also, when the addition amount of the adhering particle is not more than 40%, irregularities on the toner surface are adequate, embedding of the external additive is suppressed, and designing of the developer is easily performed.

In that case, each of the liquid dispersions of a binder resin to be used for forming the core particle and coating the shell layer may be a liquid dispersion containing a binder resin of the same kind or may be a liquid dispersion containing a binder resin of a different kind.

As a method of preparing a core particle of the toner, there is exemplified a method of manufacturing a toner by polymerizing a polymerizable monomer particle and/or forming a polymer particle in an aqueous medium, such as a suspension polymerization method, an emulsion aggregation method, a seed polymerization and a swelling polymerization method. Furthermore, in view of the fact that it is easy to prepare a toner having a structure in which a particle-containing shell layer is coated on a core particle, it is preferable to utilize a wet preparation method, especially an emulsion aggregation method.

In the emulsion aggregation method, the toner particle is obtained by mixing a resin particle dispersion prepared by emulsion polymerization or emulsification with a dispersion of additives for imparting necessary functions for an aqueous dispersion toner, such as a coloring agent, a charge controlling agent and a release agent, in an aqueous medium; aggregating and growing the dispersion in an aqueous medium using an aggregating agent or the like while mechanically shearing the mixture using a dispersing machine of every sort such as a homomixer; and then performing a step of fusing the resin particle to form a core particle.

The emulsion aggregation method in the present exemplary embodiment includes a step of forming an aggregate that is a core particle; and a particle adhering step of performing adhesion in a state where a large number of particles are projected on the surface of this aggregate.

A first half step of forming an aggregate that is the core particle includes an aggregating step of adding an aggregating agent to a mixed liquid dispersion obtained by mixing at least a first resin particle liquid dispersion composed of a first binder resin and having a first resin particle with a volume average particle diameter of not more than 1 μm dispersed therein and a coloring agent particle liquid dispersion having a coloring agent dispersed therein to form an aggregate and heating the mixture; and a fusing step of fusing and coalescing the aggregate.

A second half step of adhering a particle onto the surface of the coalesced aggregate is a step of adding a second resin particle liquid dispersion composed of a second binder resin having a second resin particle with a volume average particle diameter of not more than 1 μm dispersed therein to a mixed liquid dispersion in which the coalesced aggregate is formed as a core particle, thereby coating the core particle while adhering the second resin particle onto the surface thereof. Furthermore, for the purpose of providing irregularities on the toner surface, this step is an adhering step of adhering a large number of adhering partings onto the surface of the core particle. It is preferable that after the particle adhering step, a fusing step of fusing and coalescing the whole of core/shell particles having a particle adhered thereto is included.

In the aggregating step, a core particle prepared by merely aggregating various particle components in the mixed liquid dispersion (core-aggregated particle) may be formed, or a core particle prepared by making the heating temperature higher than a glass transition temperature of the first binder resin to achieve fusion simultaneously with the aggregation (core-fused particle) may be formed. Also, the fusing step may be performed by heating at a temperature of a glass transition temperature of the first or second binder resin, whichever is higher, or higher. However, in the case where a shell-provided aggregated particle having a particle adhered thereto is formed using a core-fused particle, the fusion may be performed utilizing a mechanical stress. Details of these steps are described later.

In general, the emulsion aggregation method is a method of preparing a resin liquid dispersion by emulsion polymerization or emulsification and meanwhile preparing a release agent particle liquid dispersion having a release agent dispersed therein, preferably a coloring agent particle liquid dispersion having a coloring agent dispersed in a solvent and mixing them to form an aggregated particle (aggregating step); and fusing and coalescing the aggregated particle by heating (fusing step), thereby obtaining a toner particle. In the present exemplary embodiment, an adhering step of adhering a large number of resin particles, preferably organic resin particles onto the surface of the aggregated particle is included after the aggregating step and before the fusing step.

Next, the toner manufacturing method which is suitable for manufacturing the toner according to the present exemplary embodiment is described in more detail.

—Manufacturing Method of Toner—

Next, as for the manufacturing method of the toner including the foregoing aggregating step, adhering step and fusing step, which is adopted in the present exemplary embodiment, the respective steps are described one-by-one in more detail.

—Aggregating Step—

In the aggregating step, first of all, an aggregating agent is added to a mixed liquid dispersion obtained by mixing a first binder resin liquid dispersion, a release agent liquid dispersion, preferably a coloring agent liquid dispersion, or other components, and the mixture is heated at a temperature slightly lower than the melting temperature of the first binder resin, thereby forming an aggregated particle (core-aggregated particle) in which particles composed of the respective components are aggregated. A fused particle (core-fused particle) may be formed by performing fusion simultaneously with aggregation by heating at a temperature of the glass transition temperature of the first binder resin or higher.

The formation of the aggregated particle is performed by adding an aggregating agent at room temperature while stirring by a rotary shearing type homogenizer. As the aggregating agent which is used for the aggregating step, in addition to surfactants having a polarity reverse to that of surfactants used for various dispersants of liquid dispersions and inorganic metal salts, complexes of a divalent or higher valent metal are suitably used.

In particular, in the case of using a metal complex, the use amount of the surfactant can be reduced, and charge characteristics can be enhanced. Therefore, the use of a metal complex is especially preferable.

Examples of the inorganic metal salt include metal salts such as calcium chloride, calcium nitrate, barium chloride, magnesium chloride, zinc chloride, aluminum chloride and aluminum sulfate; and inorganic metal salt polymers such as polyaluminum chloride, polyaluminum hydroxide and calcium polysulfide. Of these, an aluminum salt and a polymer thereof are especially suitable. For the purpose of obtaining sharper particle size distribution, the valence of the inorganic metal salt is preferably divalence than monovalence, trivalence than tetravalence, and tetravalence than trivalence. Even when the valence is identical, an inorganic metal salt polymer of a polymerization type is more preferable.

—Particle Adhering Step—

In the particle adhering step, the resin particle composed of the second binder resin and the adhering particle are adhered onto the surface or outside of the core particle containing the first binder resin having been formed through the aggregating step (core-aggregated particle or core-fused particle), thereby forming a coating layer (the aggregated particle having a coating layer formed on the surface of the core particle is hereinafter sometimes referred to as a "particle-adhered aggregated particle"). Here, this coating layer is corresponding to a shell layer of the toner according to the present exemplary embodiment to be formed through the fusing step as described later.

The shell layer-containing core particle is corresponding to the central particle.

The formation of the coating layer (shell layer) can be performed by additionally adding the liquid dispersion of the second resin particle to the liquid dispersion having the core particle formed in the aggregating step. Furthermore, by additionally adding the adhering particle, preferably the organic resin particle, irregularities can be provided on the toner surface.

It is preferable that the weight of a solid of the second binder resin and the weight of the adhering particle used for the formation of the coating layer fall within the following range.

(Second binder resin)/(Adhering particle)=0.2 to 5.0

A relationship between TgA that is a glass transition temperature of the resin of the adhering particle and TgB that is a glass transition temperature of the second binder resin is preferably (TgA>TgB). When TgA is higher than TgB, it is easy to provide irregularities on the toner surface in the fusing step.

When the resin particle composed of the second binder resin and the adhering resin are uniformly adhered onto the surface of the core particle to form the coating layer, and the obtained particle-adhered aggregated particle is heated and fused in the fusing step as described later, the resin particle composed of the second binder resin contained in the coating layer of the surface of the core particle is melted to form a shell layer. For that reason, the matter that the components contained in the core layer positioning in the inside of the shell layer, such as the release agent, is exposed on the surface of the toner is effectively prevented from occurring.

As for a method of adding and mixing the adhering particle-containing second resin particle liquid dispersion in the particle adhering step, it is preferable to add the adhering particle after previously adding the resin particle composed of the second binder resin. However, as for conditions other than this, there is no particular limitation. For example, the second resin particle liquid dispersion may be continuously added and mixed step-by-step, or may be divided several times and added and mixed stepwise. In this way, by adding and mixing the second resin particle liquid dispersion, the generation of a fine particle is suppressed, and the particle size distribution of the obtained toner becomes shape.

In the present exemplary embodiment, the number of performing the adhering step of the resin particle composed of the second binder resin may be one or plural. In the former case, only one layer composed mainly of the second binder resin is formed on the surface of the core-aggregated particle. On the other hand, in the latter case, when not only the second resin particle liquid dispersion but a plurality of the release agent liquid dispersion and the particle liquid dispersion composed of other component are utilized, layers composed mainly of a specified component are laminated and formed on the surface of the core-aggregated particle.

In the latter case, a toner having a complicated and precise layered structure can be obtained, and this case is advantageous in view of the fact that desired functions can be imparted to the toner. In the case of performing the adhering step several times or in multiple stages, a composition or physical properties can be changed stepwise from the surface to the inside of the obtained toner, and the toner structure is easily controllable. In that case, plural layers are laminated stepwise on the surface of the core particle, a structural change or composition gradient is brought from the inside to the outside of the toner particle, and physical properties are changed. Also, in that case, the shell layer is corresponding to all of the layered laminated on the surface of the core particle, and the outermost layer is constituted of a layer composed mainly of the second binder resin. The following description is made on the assumption that the adhering step is performed only one time.

A condition under which the resin particle composed of the second binder resin is adhered onto the core particle is as follows. That is, the heating temperature in the adhering step is preferably a temperature in the vicinity of the melting temperature of the first binder resin contained in the core-aggregated particle, and specifically, the heating temperature is preferably in a temperature range falling within ((melting temperature)±10° C.).

When the heating temperature is a temperature of ((melting temperature of the first binder resin)−10° C.) or more, adhesion between the resin particle composed of the first binder resin existing on the core particle surface and the resin particle composed of the second binder resin adhered on the core-aggregated particle surface is favorable compared with a case where the heating temperature is a temperature of ((melting temperature of the first binder resin)−10° C.) or less, and as a result, the thickness of the formed shell layer becomes uniform.

Also, when the heating temperature is a temperature of not more than ((melting temperature of the first binder resin)+10° C.), adhesion between the resin particle composed of the first binder resin existing on the core particle surface and the resin particle composed of the second binder resin adhered on the core particle surface is suppressed compared with a case where the heating temperature is a temperature of less than ((melting temperature of the first binder resin)+10° C.), and the obtained toner core particle is excellent in the particle diameter/particle size distribution.

Since the heating time in the adhering step relies upon the heating temperature, it cannot be unequivocally defined. However, the heating time in the adhering step is preferably from 5 minutes to 2 hours.

In the adhering step, the liquid dispersion prepared by additionally adding the second resin particle liquid dispersion to the mixed liquid dispersion having the core particle formed therein may be allowed to stand or may be gently stirred by a mixer or the like. The latter case is advantageous in view of the fact that a uniform adhering resin aggregated particle is easily formed.

—Fusing Step—

In the fusing step, the adhering resin aggregated particle obtained in the adhering step is fused by heating. The fusing step is preferably performed at a temperature of the glass transition temperature of the first or second binder resin, whichever is higher, or higher. As for the time of fusion, when the temperature of heating is high, a short time is sufficient, whereas when the temperature of heating is low, a long time is necessary. That is, since the time of fusion relies upon the temperature of heating, it cannot be unequivocally defined. However, the tine of fusion is preferably from 30 minutes to 10 hours.

Also, when the core particle is a core-fused particle, the resin particle composed of the second binder resin may be adhered. In that case, the liquid dispersion containing the core-fused particle is once filtered, thereby controlling a moisture content of the liquid dispersion to from 30% by weight to 50% by weight, and thereafter, the second resin particle liquid dispersion is further added. According to this, the particle composed of the second binder resin is adhered onto the surface of the core-fused particle.

When the moisture content of the liquid dispersion is 30% by weight or more, adhesiveness of the particle composed of the second binder resin is favorable, and liberation of the core-fused particle of this particle is suppressed. Also, when the moisture content of the liquid dispersion is not more than 50% by weight, stirring is easy, and the particle composed of the second binder resin is uniformly adhered onto the core-fused particle surface.

After completion of a washing/drying step as described later, by applying a mechanical stress by a Henschel mixer or the like to the particle-adhered aggregated particle obtained by adhering the particle composed of the second binder resin and the adhering particle onto the surface of the core-fused particle, the particle composed of the second binder resin adhered onto the core-fused particle surface is fused. In this way, the fusing step may be performed by applying a mechanical stress in place of heating in a liquid phase.

—Washing/Drying Step—

It is preferable that the fused particle obtained through the fusing step is subjected to solid-liquid separation such as filtration, or washing and drying. According to this, a toner in a state where an external additive is not added is obtained.

Though the solid-liquid separation is not particularly limited, suction filtration, pressure filtration or the like is preferable in view of productivity. As for washing, it is preferable to thoroughly perform displacement washing with ion-exchanged water in view of chargeability. In the drying step, an arbitrary usual method such as a vibration type fluidized drying method, a spray drying method, a freeze drying method and a flash jet drying method is adopted. A water content of the toner particle after drying is adjusted to preferably not more than 1.0% by weight, and more preferably not more than 0.5% by weight.

—Preparation of Liquid Dispersion—

For the preparation of the binder resin liquid dispersion, a known emulsification method is adopted. However, a phase inversion method in which the obtained particle size distribution is shape, and the volume average particle diameter is easily obtainable within the range of from 0.08 μm to 0.40 μm is effective.

In the phase inversion method, the resin is dissolved in an organic solvent capable of dissolving the resin therein and further, an amphipathic organic solvent singly or a mixed solvent, to form an oil phase. A small amount of a basic compound is dropped while stirring the oil phase, and water is further dropped step-by-step while stirring, whereby water drops are taken into the oil phase. Subsequently, when the dropping amount of water exceeds a certain amount, the oil phase and the water phase are inversed, whereby the oil phase becomes an oil droplet. Thereafter, a water liquid dispersion is obtained through a desolvation step under reduced pressure.

The amphipathic organic solvent as referred to herein is one having a solubility in water at 20° C. of preferably 5 g/L or more, and more preferably 10 g/L or more. When this solubility is 5 g/L or more, an excellent acceleration effect of an aqueous treatment speed is revealed, and the obtained water dispersion is excellent in storage stability.

Also, examples of such an organic solvent include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methyl isobutyl ketone, ethyl butyl ketone, cyclohexanone and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxy acetate, methyl propionate, ethyl propionate, diethyl carbonate and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether acetate; 3-methoxy-3-methyl butanol; 3-methoxybutanol; acetonitrile; dimethylformamide; dimethylacetamide; diacetone alcohol; and ethyl acetoacetate.

These solvents may be used singly or in admixture of two or more kinds thereof.

Next, as for the basic compound, in the present exemplary embodiment, it is preferable that the polyester resin used as the binder resin is neutralized with the basic compound upon being dispersed in an aqueous medium. In the present exemplary embodiment, a neutralization reaction with the carboxyl group of the polyester resin is a motive power of the aqueous treatment, and the particle-to-particle aggregation is prevented by an electrical repulsive power among formed carboxyl anions.

Examples of the basic compound include ammonia and an organic amine compound having a boiling temperature of not higher than 250° C.

Examples of the preferred organic amine compound include triethylamine, N,N-diethylethanolamine, N,N-dimethylethanolamine, amino ethanol amine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine and N-ethylmorpholine.

The basic compound is preferably added in an amount in which at least a part thereof is able to be neutralized depending upon the carboxyl group contained in the polyester resin, namely from 0.2 molar equivalents to 9.0 molar equivalents, more preferably from 0.6 molar equivalents to 2.0 molar equivalents depending upon the carboxyl group. When the amount of the basic compound is 0.2 molar equivalents or more, the effects to be brought due to the addition of the basic compound are thoroughly obtainable; and when the amount of the basic compound is not more than 9.0 molar equivalents, a favorable liquid dispersion having proper hydrophilicity of the oil phase and narrow particle diameter distribution is obtainable.

The release agent liquid dispersion is one having at least a release agent dispersed therein.

The release agent is dispersed by a known method. For example, a rotary shearing type homogenizer, a media dispersing machine (for example, a ball mill, a sand mill, an attritor, etc.), a high-pressure counter collision dispersing machine or the like is preferably used. Also, the release agent particle liquid dispersion may be prepared by dispersing the release agent in an aqueous solvent using an ionic surfactant having a polarity by the foregoing homogenizer. In the present exemplary embodiment, the release agent may be used singly or in combinations of two or more kinds thereof. An average particle diameter of the release agent particle is preferably not more than 1.0 μm, and more preferably from 0.1 μm to 0.5 μm.

The coloring agent liquid dispersion is one having at least a coloring agent dispersed therein.

The coloring agent is dispersed by a known method. For example, a rotary shearing type homogenizer, a media dispersing machine (for example, a ball mill, a sand mill, an attritor, etc.), a high-pressure counter collision dispersing machine or the like is preferably used. Also, the coloring agent particle liquid dispersion may be prepared by dispersing the release agent in an aqueous solvent using an ionic surfactant having a polarity by the foregoing homogenizer. In the present exemplary embodiment, the coloring agent may be used singly or in combinations of two or more kinds thereof. A volume average particle diameter (hereinafter sometimes referred to simply as an "average particle diameter") of the coloring agent is preferably not more than 1 μm, more preferably not more than 0.5 μm, and still more preferably from 0.01 μm to 0.5 μm.

A combination of the resin of the resin particle, the release agent and the coloring agent is not particularly limited and is properly freely chosen and used depending upon the purpose.

In the present exemplary embodiment, other component (particle) such as an internal additive, a charge controlling agent, an inorganic particle, an organic particle, a lubricant and an abrasive may be dispersed in at least any of the binder resin liquid dispersion, the release agent liquid dispersion or the coloring agent liquid dispersion depending upon the purpose. In that case, other component (particle) may be dispersed in at least any of the binder resin liquid dispersion, the release agent liquid dispersion or the coloring agent liquid dispersion, or a liquid dispersion having other component (particle) dispersed therein may be mixed in a liquid mixture having the binder resin liquid dispersion, the release agent liquid dispersion and the coloring agent liquid dispersion mixed therein.

Examples of a dispersion medium in the binder resin liquid dispersion, the release agent liquid dispersion, the coloring agent liquid dispersion and other component include aqueous media such as water.

Examples of the aqueous medium include water such as distilled water and ion-exchanged water and an alcohol. These materials may be used singly or in combinations of two or more kinds thereof. As a suitable combination, it is preferable to use distilled water and ion-exchanged water. The addition of the surfactant is advantageous from the standpoints of not only stability of each of the dispersed particles including the resin particle, the coloring agent particle and the release agent particle in the aqueous medium, in its turn stability of the liquid dispersion but stability of the aggregated particle in the aggregating step.

Also, examples of a dispersant which is added from the purposes of making the dispersion stability of the coloring agent in the aqueous medium more stable and reducing energy of the coloring agent in the toner include rosin, a rosin derivative, a coupling agent and a polymer dispersant.

In the present exemplary embodiment, for the purpose of enhancing the dispersion stability, it is preferable that the surfactant is added and mixed in the aqueous medium.

A volume average primary particle diameter of the thus obtained particle liquid dispersion is, for example, measure by a laser diffraction type particle size distribution analyzer (LA-700, manufactured by Horiba, Ltd.). As for a measurement method, a sample in a state of a liquid dispersion is adjusted so as to have a solids content of about 2 g, and ion-exchanged water is added thereto to make to about 40 mL. This is charged in a cell so as to reach an appropriate concentration, and after elapsing about 2 minutes, at a point where the concentration in the cell becomes substantially stable, the measurement is performed. A volume primary particle diameter of every obtained channel is accumulated from the small volume primary particle diameter side, and the particle diameter at 50% accumulation is defined as the volume average primary particle diameter.

—External Addition Step—

A method for externally adding an inorganic particle such as silica and titania on the surface of the toner matrix particle is not particularly limited, and a known method is adopted. For example, a method of adhering the organic particle by a mechanical method or chemical method is exemplified.

(Electrostatic Image Developer)

The electrostatic image developing toner according to the present exemplary embodiment is used as an electrostatic image developer.

The electrostatic image developer according to the present exemplary embodiment is not particularly limited, except for the matter that it contains the electrostatic image developing toner according to the present exemplary embodiment, and it is able to take a proper component composition depending upon the purpose. When the electrostatic image developing toner according to the present exemplary embodiment is used singly, an electrostatic image developer of a one-component system is prepared, and when the electrostatic image developing toner according to the present exemplary embodiment is used in combination with a carrier, an electrostatic image developer of a two-component system is prepared.

As for the one-component developer, a method in which frictional electrification with a developing sleeve or charge member is performed to form a charged toner, followed by developing depending upon an electrostatic latent image is also applied.

In the present exemplary embodiment, though the development system is not specified, a two-component development system is preferable. Also, so far as the foregoing condition is satisfied, the carrier is not particularly specified. However, examples of a core material of the carrier include magnetic metals (for example, iron, steel, nickel, cobalt, etc.) and alloys thereof with manganese, chromium, a rare earth or the like; and magnetic oxides (for example, ferrite, magnetite, etc.). From the viewpoints of core material surface properties and core material resistance, ferrite, especially an alloy thereof with manganese, lithium, strontium, magnesium, etc. is preferable.

The carrier which is used in the present exemplary embodiment is preferably one obtained by coating a resin on the core material surface. The resin is not particularly limited and is properly chosen depending upon the purpose. Examples thereof include resins which are known per se, such as polyolefin based resins (for example, polyethylene, polypropylene, etc.); polyvinyl based resins and polyvinylidene based resins (for example, polystyrene, acrylic resins, polyacrylonitrile, polyvinyl acetate, polyvinyl alcohol, polyvinyl butyral, polyvinyl chloride, polyvinylcarbazole, polyvinyl ether, polyvinyl ketone, etc.); a vinyl chloride-vinyl acetate copolymer; a styrene-acrylic acid copolymer; a straight silicone resin composed of an organosiloxane bond or modified products thereof; fluorocarbon based resins (for example, polytetrafluoroethylene, polyvinyl fluoride, polyvinylidene fluoride, polychlorotrifluoroethylene, etc.); silicone resins; polyesters; polyurethanes; polycarbonates; phenol resins; amino resins (for example, a urea-formaldehyde resin, a melamine resin, a benzoguanamine resin, a urea resin, a polyamide resin, etc.); and epoxy resins. These resins may be used singly or in combinations of two or more kinds thereof. In the present exemplary embodiment, among these resins, it is preferable to use at least a fluorocarbon based resin and/or a silicone resin. The use of at least a fluorocarbon based resin and/or a silicone resin as the resin is advantageous in view of the fact that the effect of preventing carrier contamination (impaction) due to the toner or external additive is high.

As for the coating made of the foregoing resin, it is preferable that a resin particle and/or a conductive particle is dispersed in the resin. Examples of the resin particle include a thermoplastic resin particle and a thermosetting resin particle. Of these, a thermosetting resin is preferable from the viewpoint that it is relatively easy to increase the hardness, and a resin particle composed of a nitrogen-containing resin containing an N atom is preferably from the viewpoint of imparting negative chargeability to the toner. These resin particles may be used singly or in combinations of two or more kinds thereof. An average particle diameter of the resin particle is preferably from 0.1 μm to 2 μm, and more preferably from 0.2 μm to 1 μm. When the average particle diameter of the resin particle is 0.1 μm or more, the dispersibility of the resin particle in the coating is excellent, whereas when the average particle diameter of the resin particle is not more than 2 μm, dropping of the resin particle from the coating hardly occurs.

Examples of the conductive particle include metal particles of gold, silver, copper and the like; carbon black particles; and particles obtained by coating the surface of a powder of titanium oxide, zinc oxide, barium sulfate, aluminum borate, potassium titanate or the like with tin oxide, carbon black, a metal or the like. These materials may be used singly or in combinations of two or more kinds thereof. Of these, carbon black particles are preferable in view of the fact that manufacturing stability, costs, conductivity and so on are favorable. Though the kind of carbon black is not particularly limited, carbon black having a DBP oil absorption of from 50 mL/100 g to 250 mL/100 g is preferable because of its excellent manufacturing stability. A coating amount of each of the resin, the resin particle and the conductive particle on the core material surface is preferably from 0.5% by weight to 5.0% by weight, and more preferably from 0.7% by weight to 3.0% by weight.

Though a method for forming the coating is not particularly limited, examples thereof include a method using a coating film forming solution in which the resin particle such as a crosslinking resin particle and/or the conductive particle, and the resin such as a styrene-acrylic resin, a fluorocarbon based resin and a silicone resin as a matrix resin are contained in a solvent.

Specific examples thereof include an immersion method of immersing the carrier core material in the coating film forming solution; a spray method of spraying the coating film forming solution onto the surface of the carrier core material; and a kneader coater method of mixing the coating film forming solution and the carrier core material in a state where it is floated by flowing air and removing the solvent. Of these, the kneader coater method is preferable in the present exemplary embodiment.

The solvent used in the coating film forming solution is not particularly limited so far as it is capable of dissolving only the resin that is a matrix resin. The solvent is chosen from solvents which are known per se, and examples thereof include aromatic hydrocarbons such as toluene and xylene, ketones such as acetone and methyl ethyl ketone, and ethers such as tetrahydrofuran and dioxane. In the case where the resin particle is dispersed in the coating, since the resin particle and the particle as a matrix resin are uniformly dispersed in the thickness direction thereof and in the tangential direction to the carrier surface, even when the carrier is used for a long period of time, and the coating is abraded, the surface formation which is similar to that of unused ones can be always kept, and a favorable ability of applying electrification to the toner can be kept over a long period of time. Also, in the case where the conductive particle is dispersed in the coating, since the conductive particle and the resin as a matrix resin are uniformly dispersed in the thickness direction thereof and in a tangential direction to the carrier surface, even when the carrier is used for a long period of time, and the coating is abraded, the surface formation which is similar to that of unused ones can be always kept, and deterioration of the carrier can be prevented over a long period of time. In the case where the resin particle and the conductive particle are dispersed in the coating, the foregoing effects can be exhibited at the same time.

An electrical resistance of the whole of the thus formed magnetic carrier in a magnetic brush state in an electric field of $10^4$ V/cm is preferably from $10^8$ Ωcm to $10^{13}$ Ωcm. When the electrical resistance of the magnetic carrier is $10^8$ Ωcm or more, adhesion of the carrier to an image area on the image holding member is suppressed, and a brush mark is hardly produced. On the other hand, where the electrical resistance of the magnetic carrier is not more than $10^{13}$ Ωcm, the generation of an edge effect is suppressed, and a favorable image quality is obtainable.

A volume resistivity is measured as follows.

A sample is placed on a lower grid of a measuring jig that is a pair of 20-$cm^2$ circular grids (made of steel) connected to an electrometer (a trade name: KEITHLEY 610C, manufactured by Keithley Instruments Inc.) and a high-voltage power supply (a trade name: FLUKE 415B, manufactured by Fluke Corporation), so as to form a flat layer having a thickness of from about 1 mm to 3 mm. Subsequently, after the sample is placed on the upper grid, in order to make a sample-to-sample space free, a weight of 4 kg is placed on the upper grid. A thickness of the sample layer is measured in this state. Subsequently, by impressing a voltage to the both grids, a current value is measured, and a volume resistivity is calculated according to the following expression.

(Volume resistivity)=(Impressed voltage)×20÷((Current value)−(Initial current value))÷(Sample Thickness)

In the foregoing expression, the initial current value is a current value when the impressed voltage is 0; and the current value is a measured current value.

As for a mixing proportion of the toner according to the present exemplary embodiment to the carrier in the electrostatic image developer of a two-component system, the amount of the toner is from 2 parts by weight to 10 parts by weight based on 100 parts by weight of the carrier. Also, a preparation method of the developer is not particularly limited, and examples thereof include a method of mixing by a V-blender or the like.

(Image Forming Method)

Also, the electrostatic image developer (electrostatic image developing toner) is used for an image forming method of an electrostatic image development mode (electrophotographic mode).

The image forming method according to the present exemplary embodiment includes a charging step of charging an image holding member; a latent image forming step of forming an electrostatic latent image on the surface of the image holding member; a developing step of developing the electrostatic latent image formed on the surface of the image holding member with an electrostatic image developing toner or an electrostatic image developer containing an electrostatic image developing toner to form a toner image; a transferring step of transferring the toner image formed on the surface of the image holding member onto the surface of a transfer-receiving material; and a fixing step of fixing the transferred toner image onto a medium to be recorded.

The image forming method according to the present exemplary embodiment is performed using an image forming apparatus which is known per se, such as copiers and facsimiles.

The charging step is a step of charging an image holding member.

The latent image forming step is a step of forming an electrostatic latent image on the surface of the image holding member.

The developing step is a step of developing the electrostatic latent image formed on the surface of the image holding member with the electrostatic image developing toner according to the present exemplary embodiment or an electrostatic image developer containing the electrostatic image developing toner according to the present exemplary embodiment to form a toner image.

The transferring step is a step of transferring the toner image onto a transfer-receiving material.

The fixing step is a step of allowing the transfer-receiving material having the unfixed toner image formed thereon to pass between a heating member and a heating member to fix the toner image.

As for the heating member which is used in the fixing step, at least the most surficial layer has surface energy of preferably from $30\times10^{-3}$ N/m to $3{,}000\times10^{-3}$ N/m, and more preferably from $300\times10^{-3}$ N/m to $1{,}500\times10^{-3}$ N/m.

The heating member having high surface energy is preferably formed of a metal material or an inorganic material, and more preferably formed of a metal material.

Examples of the metal material for forming the heating member include Fe, Cr, Cu, Ni, Co, Mn, Al, stainless steel and alloys or oxides thereof. Of these, Al or stainless stress is preferable, and Al is more preferable.

Examples of the inorganic material for forming the heating member include glass and a ceramic.

As for the heating member, it is preferable that at least the most surficial layer thereof is formed of the foregoing metal material or inorganic material. For example, the whole of the heating member may be formed of the foregoing metal material or inorganic material, or the most surficial layer of the heating member may be formed of the foregoing metal material or inorganic material, with other portion than the most surficial layer being formed of other material.

Examples of a shape of the heating member include a cylindrical roll shape.

In the fixing step, the heating member is heated at the melting temperature of the release agent or higher, and the release agent contained in the toner is in a molten state by the heating member. A temperature of the heating member in the fixing step is preferably from 130° C. to 170° C., and more preferably from 140° C. to 160° C. When the temperature of the heating member falls within the foregoing ranges, the release agent contained in the toner is surely in a molten state.

As described previously, the release agent which is used in the present exemplary embodiment contains an organosilicon compound having a siloxane bond, and its contact angle with the heating member in a molten state is not more than 50°. For that reason, the release agent having eluted from the toner evenly spreads onto the heating member with high affinity, and migration of the release agent into a medium to be recording such as paper to be subsequently subjected to image formation is reduced. In this way, contamination of a feed roll for conveying the medium to be recorded after the image formation by the release agent is suppressed, and a defective motion at the time of continuous operation is suppressed.

(Image Forming Apparatus)

The image forming apparatus according to the present exemplary embodiment includes an image holding member; a charging unit for charging the image holding member; a latent image forming unit for forming an electrostatic latent image on the surface of the image holding member; a developing unit for developing the electrostatic latent image formed on the surface of the image holding member with an electrostatic image developing toner or an electrostatic image developer containing an electrostatic image developing toner to form a toner image; a transfer unit for transferring the toner image formed on the surface of the image holding member onto the surface of a transfer-receiving material; and a fixing unit for allowing the transfer-receiving material having the unfixed toner image formed thereon to pass between a heating member and a heating member to fix the toner image.

As for the image holding member and the respective units, the configurations mentioned in the respective steps of the foregoing image forming method are preferably used.

As for all of the foregoing respective units, units which are known in the image forming apparatus are utilized. Also, the image forming apparatus which is used in the present exemplary embodiment may be one including other units or apparatuses than the foregoing configurations. Also, in the image forming apparatus which is used in the present exemplary embodiment, a plurality of the foregoing units may be executed at the same time.

(Toner Cartridge and Process Cartridge)

A toner cartridge according to the present exemplary embodiment is a toner cartridge that accommodates at least the electrostatic image developing toner according to the present exemplary embodiment. The toner cartridge according to the present exemplary embodiment may store the electrostatic image developing toner according to the present exemplary embodiment as an electrostatic image developer.

Also, a process cartridge according to the present exemplary embodiment is a process cartridge that includes at least one member selected from the group consisting of a developing unit for developing an electrostatic latent image formed on the surface of an image holding member with the electrostatic image developing toner or the electrostatic image developer to form a toner image; an image holding member; a charging unit for charging the surface of the image holding member; and a cleaning unit for removing a toner remaining on the surface of the image holding member; and accommodates at least the electrostatic image developing toner according to the present exemplary embodiment or the electrostatic image developer according to the present exemplary embodiment.

It is preferable that the toner cartridge according to the present exemplary embodiment is detachable against the image forming apparatus. That is, in the image forming apparatus having such a configuration that a toner cartridge is detachable, the toner cartridge according to the present exemplary embodiment, which stores the toner according to the present exemplary embodiment, is suitably used.

Also, the toner cartridge may be a cartridge storing a toner and a carrier, and a cartridge storing a toner alone and a cartridge storing a carrier alone may be provided separately.

It is preferable that the process cartridge according to the present exemplary embodiment is removable against the image forming apparatus.

Also, the process cartridge according to the present exemplary embodiment may include a discharging unit or other member, if desired.

As for the toner cartridge and the process cartridge, known configurations may be adopted.

(Example of Image Forming Apparatus)

Figure 2:
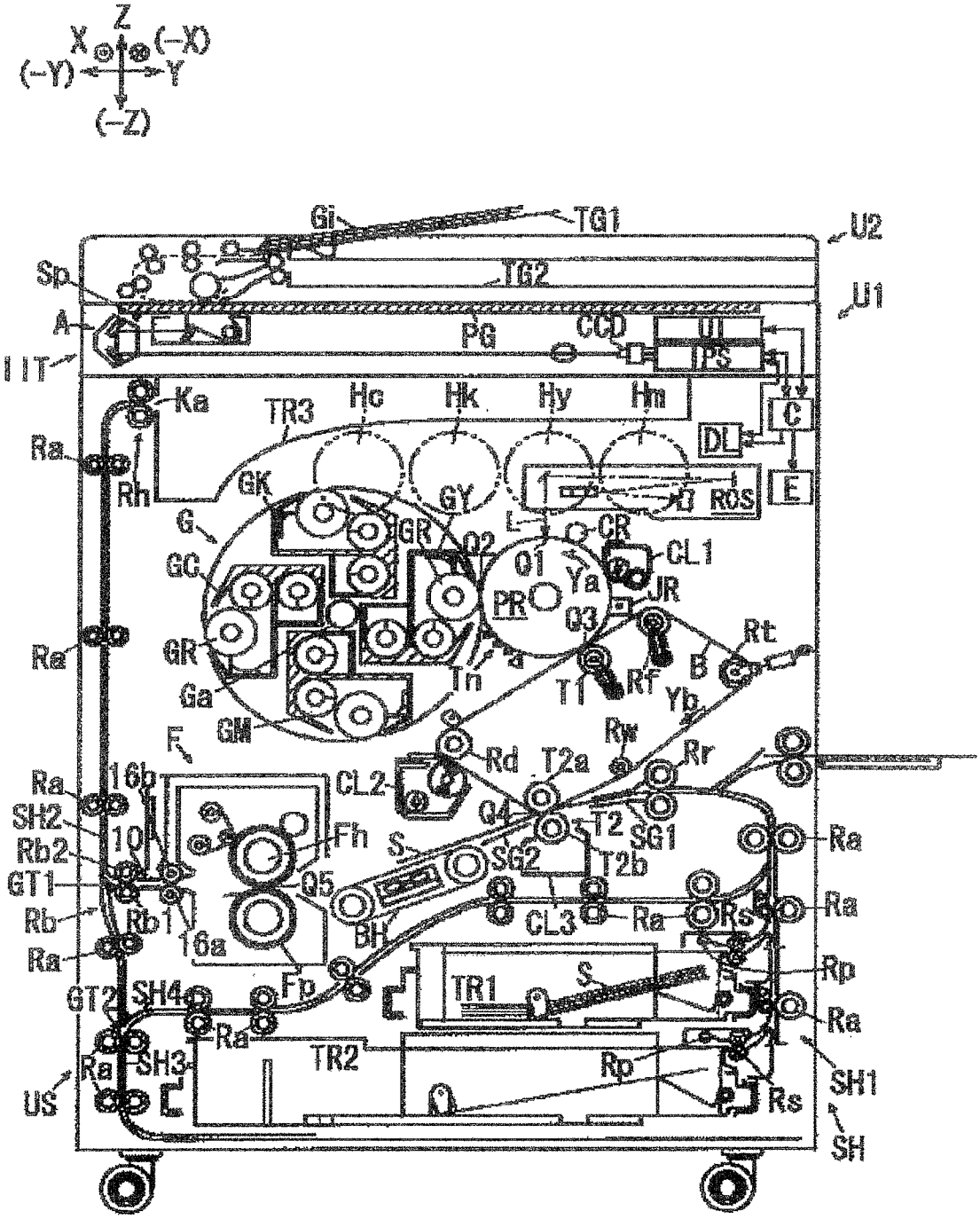
FIG. 2 is a diagrammatic sectional view showing an example of an image forming apparatus according to a present exemplary embodiment.

An example of the image forming apparatus according to the present exemplary embodiment is described by reference to FIG. 2, but it should be construed that the present exemplary embodiment is not limited thereto at all. FIG. 2 is a diagrammatic sectional view showing an example of the image forming apparatus according to the present exemplary embodiment.

In FIG. 2, an automatic original feeding device U2 is placed on an upper surface of platen glass PG in an upper end of an image forming apparatus U1 constructed of a copier. The automatic original feeding device U2 has an original paper feeding tray TG1 on which plural originals Gi to be copied are laid. The automatic original feeding device U2 is configured in such a manner that each of the plural originals Gi laid on the original paper feeding tray TG1 successively passes through a copying position and is ejected into an original paper ejecting tray TG2. The automatic original paper ejecting tray TG2 is rotatable against the image forming apparatus U1 by a hinge shaft (not shown) extending in the left and right directions, which is provided in a rear end (−X end), and is rotated upward when a worker manually places the original Gi on the platen glass PG.

The image forming apparatus U1 has U1 (user interface) for a user to execute an input operation of an operation command signal such as "start copying". An original reading device IIT disposed beneath the transparent platen glass PG on the upper surface of the image forming apparatus U1 has an exposure system register sensor (platen register sensor) Sp arranged in a platen register position (OPT position) and an exposure optical system A. In the exposure optical system A, its movement and stop are controlled by a detection signal of the exposure system register sensor Sp, and the exposure optical system A always stops in a home position. Reflected light from the original Gi passing through the exposure position on an upper surface of the platen glass PG by the automatic original feeding device U2 or from the original manually placed on the platen glass PG is converted into electrical signals of R (red), G (green) and B (blue) by a solid state imaging device CCD via the exposure optical system A.

An image processing system IPS converts the RGB electrical signals inputted from the solid state imaging device CCD into image data of K (black), Y (yellow), M (magenta) and C (cyan), temporarily stores them and then outputs the image data as image data for forming a latent image into a laser drive circuit DL at a prescribed timing. The laser drive circuit DL outputs laser drive signals into a latent image forming device ROS according to the inputted image data. The operation of the image processing system IPS and laser drive circuit DL are controlled by a controller C constructed from a microcomputer.

An image holding member PR rotates in an arrow Ya direction, and after its surface is uniformly charged by a charging unit (charge roll) CR, the image holding member PR is exposed and scanned by a laser beam L of the latent image forming device ROS in a latent image writing position Q1, thereby forming an electrostatic latent image. In the case of forming a full-color image, electrostatic latent images are successively formed corresponding to four color images of K (black), Y (yellow), M (magenta) and C (cyan); and in the case of a monochromic image, only an electrostatic latent image corresponding to a K (black) image is formed.

The surface of the image holding member PR having the electrostatic latent image formed thereon rotates and moves and successively passes through a developing region Q2 and a primary transfer region Q3. A rotary type developing device G has developing units GL, GY, GM and GC of four colors of K (black), Y (yellow), M (magenta) and C (cyan) successively rotating and moving into the developing region Q2 following the rotation of a rotating shaft Ga. Each of the developing units GK, GY, GM and GC of the respective colors has a developing roll GR for conveying the developer into the developing region Q2 and develops an electrostatic latent image on the image holding member PR passing through the developing region Q2 into a toner image. Developing containers of the respective developing units GK, GY, GM and GC are configured in such a manner that toners of respective colors are supplied from toner supply cartridges installed in cartridge installing parts Hk, Hy, Hm and He (see FIG. 1).

In a lower portion of the image holding member PR, there are provided plural belt supporting rolls (Rd, Rt, Rw, Rf and T2*a*) including an intermediate transfer belt B, a belt drive roll Rd, a tension roll Rt, a walking roll Rw, an idler roll (free roll) Rf and a backup roll T2*a*, a primary transfer roll T1 and a belt frame supporting them (not shown). The intermediate transfer belt B is supported by the belt supporting rolls (Rd, Rt, Rw, Rf and T2*a*) in a rotatable and movable manner and rotates in an arrow Yb direction at the time of operation of the image forming apparatus.

In the case of forming a full-color image, a first-color electrostatic latent image is formed in the latent image writing position Q1, and a first-color toner image Tn is formed in the developing region Q2. At the time of passing through the primary transfer region Q3, this toner image Tn is electrostatically primarily transferred onto the intermediate transfer belt B by the primary transfer roll T1. Thereafter, second-color, third-color and fourth-color toner images Tn are similarly successively laid and primarily transferred onto the intermediate transfer belt B having the first-color toner image Tn carried thereon, and finally, a full-color multiple toner image is formed on the intermediate transfer belt B. In the case of forming a single-color monochromic image, only one developing unit is used, and a single-color toner image is primarily transferred onto the intermediate transfer belt B. After the primary transfer, the surface of the image holding member PR is subjected to discharge of the residual toner by a discharging unit JR and cleaned by an image holding member cleaner CL1.

In a lower portion of the backup roll T2*a*, a secondary transfer roll T2*b* is movably disposed between a position separated from the backup roll T2*a* and a position coming into contact therewith. A secondary transfer unit T2 is constructed of the backup roll T2*a* and the secondary transfer roll T2*b*. A secondary transfer region Q4 is formed by a contacting region between the backup roll T2*a* and the secondary transfer roll T2*b*. A secondary transfer voltage having a polarity reverse to the charge polarity used in the developing apparatus G is fed from a power source circuit E, and the power source circuit E is controlled by the controller C.

Recording sheets S accommodated in paper feeding trays TR1 and TR2 are taken out by a pickup roll Rp at a prescribed timing, separated one-by-one by a separating roll Rs and then conveyed into a register roll Rr by plural conveying rolls Ra of a paper feed path SH1. The recording sheet S conveyed into the register roll Rr is conveyed from a sheet guide 501 before transfer to a secondary transfer region Q4 in conformity with a timing at which the primarily transferred multiple toner image or single-color toner image moves into the secondary transfer region Q4. In the secondary transfer region Q4, the secondary transfer unit T2 electrostatically secondarily transfers the toner image on the intermediate transfer belt B into the recording sheet S. In the intermediate transfer belt B after the secondary transfer, the residual toner is removed by a belt cleaner CL2. A toner image forming apparatus (PR+CR+G+T1+B+T2) for transferring the toner image onto the recording sheet S and forming an image is constructed of the foregoing image holding member PR, charge roll CR, developing device G, primary transfer roll T1, intermediate transfer belt B and secondary transfer unit T2 and so on.

The secondary transfer roll Tb and the belt cleaner CL2 are arranged in such a manner that they are free from separation from or contact with the intermediate transfer belt B, and in the case of forming a color image, the secondary transfer roll Tb and the belt cleaner CL2 are separated from the intermediate transfer belt B until an unfixed toner image of a final color is primarily transferred onto the intermediate transfer belt B. A secondary transfer roll cleaner CL3 moves in a separated manner relative to the intermediate transfer belt B along with the secondary transfer roll T2*b*. The recording sheet S having the toner image secondarily transferred thereonto is conveyed into a fixing region Q5 by a sheet guide SG2 after transfer and a sheet conveying belt BH. The fixing region Q5 is a region (nip) where a heat roll Fh and a pressure roll Fp of a fixing device F come into press contact with each other, and the recording sheet S passing through the fixing region Q5 is heat fixed by the fixing device F. The heat roll Fh is formed of, for example, a metal material.

In FIG. 2, a sheet conveying roll 16 having a drive roll 16*a* and a driven roll 16*b*; a sheet conveying roll Rb having a drive roll Rb1 and a driven roll Rb2; and a sheet ejecting path SH2 are successively provided on the downstream side of the fixing region Q5 for fixing the toner image of the recording sheet S. A sheet inverting path SH3 is connected to the sheet ejecting path SH2. A switching gate GT1 is provided at a turning point between the sheet ejecting path SH2 and the sheet inverting path SH3. The recording sheet S conveyed into the sheet ejecting path SH2 is conveyed into a sheet ejecting roll Rh by the plural conveying rolls Ra and then ejected into a paper ejecting tray TR3 from a sheet ejecting port Ka formed in an upper end of the image forming apparatus U1. A sheet circulating path SH4 is connected to the sheet inverting path SH3, and a Mylar gate GT2 constructed of a sheet-shaped member is provided in the connection part. The Mylar gate GT2 allows the recording sheet S having been conveyed from the switching gate GT1 to the sheet inverting path SH3 to pass therethrough as it is and also allows the recording sheet S having once passed and then switched back to go toward the side of the sheet circulating path SH4. The recording sheet S conveyed into the sheet circulating path SH4 passes through the paper feed path SH1 and is resent to the transfer region Q4. A sheet conveying path SH is constructed of elements expressed by the foregoing symbols SH1 to SH4. A sheet conveying device US is constructed of the sheet conveying path SH and the rolls Ra and Rh having a sheet conveying ability as disposed therein and so on.

EXAMPLES

The present exemplary embodiments are hereunder described in detail while referring to the following Examples, but it should be construed that the present exemplary embodiments are not limited to these Examples at all. The term "parts" in the following description expresses "parts by weight" unless otherwise indicated.

<Synthesis of Polyester as a Binder Resin>

—Preparation of Polyester Resin (1)—

Bisphenol A-ethylene oxide (2 moles) adduct: 114 parts
Bisphenol A-propylene oxide (2 moles) adduct: 84 parts
Dimethyl terephthalate: 75 parts
Dodecenyl succinic acid: 19.5 parts
Trimellitic acid: 7.5 parts The foregoing components are charged in a flask equipped with a stirrer, a nitrogen gas-introducing tube, a temperature sensor and a rectifying column; the temperature is increased to 190° C. over one hour; after stirring the inside of the reaction system, 3.0 parts of dibutyltin oxide is added. Furthermore, the temperature is increased from 190° C. to 240° C. over 6 hours while distilling off produced water, and a dehydration condensation reaction is continued at 240° C. for an additional 2 hours, thereby synthesizing a polyester resin (1).

The obtained polyester resin (1) has a glass transition temperature of 54° C., an acid number of 15.3 mg-KOH/g, a weight average molecular weight of 58,000 and a number average molecular weight of 5,600.

—Preparation of Polyester Resin (2)—

Bisphenol A-ethylene oxide (2 moles) adduct: 114 parts
Bisphenol A-propylene oxide (2 moles) adduct: 84 parts
Dimethyl terephthalate: 75 parts
Dodecenyl succinic acid: 19.5 parts
Trimellitic acid: 7.5 parts The foregoing components are charged in a flask equipped with a stirrer, a nitrogen gas-introducing tube, a temperature sensor and a rectifying column; the temperature is increased to 190° C. over one hour; after stirring the inside of the reaction system, 3.0 parts of dibutyltin oxide is added. Furthermore, the temperature is increased from 190° C. to 240° C. over 6 hours while distilling off produced water, and a dehydration condensation reaction is continued at 240° C. for an additional 5 hours, thereby synthesizing a polyester resin (2).

The obtained polyester resin (2) has a glass transition temperature of 54° C., an acid number of 15.3 mg-KOH/g, a weight average molecular weight of 120,000 and a number average molecular weight of 9,000.

—Preparation of Polyester Resin Liquid Dispersion (1)—

Polyester resin (1) (Mw: 58,000): 160 parts by weight
Ethyl acetate: 233 parts
Sodium hydroxide aqueous solution (0.3 N): 0.1 parts The foregoing components are charged in a separable flask, heated at 70° C. and stirred by a three-one motor (manufactured by Shinto Scientific Co., Ltd.) to prepare a resin mixed liquid. 373 parts of ion-exchanged water is further added step-by-step to this resin mixed liquid with stirring to perform phase inversion emulsification, followed by desolvation to obtain a polyester resin liquid dispersion (1) (solid content concentration: 30%). The resin particle in the liquid dispersion has a volume average particle diameter of 160 nm.

—Preparation of Polyester Resin Liquid Dispersion (2)—

Polyester resin (2) (Mw: 120,000): 160 parts

Ethyl acetate: 160 parts

Sodium hydroxide aqueous solution (0.3 N): 0.1 parts

The foregoing components are charged in a separable flask, heated at 70° C. and stirred by a three-one motor (manufactured by Shinto Scientific Co., Ltd.) to prepare a resin mixed liquid. 373 parts of ion-exchanged water is further added step-by-step to this resin mixed liquid with stirring to perform phase inversion emulsification, followed by desolvation to obtain a polyester resin liquid dispersion (2) (solid content concentration: 30%). The resin particle in the liquid dispersion has a volume average particle diameter of 320 nm.

—Preparation of Polyester Resin Liquid Dispersion (3)—

Polyester resin (2) (Mw: 120,000): 160 parts

Ethyl acetate: 120 parts

Sodium hydroxide aqueous solution (0.3 N): 0.1 parts

The foregoing components are added in a separable flask, heated at 70° C. and stirred by a three-one motor (manufactured by Shinto Scientific Co., Ltd.) to prepare a resin mixed liquid. 373 parts of ion-exchanged water is further added step-by-step to this resin mixed liquid with stirring to perform phase inversion emulsification, followed by desolvation to obtain a polyester resin liquid dispersion (3) (solid content concentration: 30%). The resin particle in the liquid dispersion has a volume average particle diameter of 470 nm.

An acrylic resin liquid dispersion is prepared as an aggregated particle forming binder resin.

—Preparation of Styrene-Acrylic Resin Liquid Dispersion (1)—

Styrene: 308 parts n-Butyl acrylate: 100 parts by weight

Acrylic acid: 4 parts by weight

Dodecane thiol: 5 parts by weight

Propanediol acrylate: 1.5 parts by weight

The foregoing components are mixed and dissolved, whereas a solution prepared by dissolving 4 parts by weight of an anionic surfactant, Dowfax (manufactured by The Dow Chemical Company) in 550 parts by weight of ion-exchanged water is accommodated in a flask; the foregoing mixed solution is added, dispersed and emulsified; and 50 parts of an ion-exchanged aqueous solution having 6 parts by weight of ammonium persulfate dissolved therein is added while gradually stirring and mixing for 10 minutes.

Subsequently, after the inside of the system is thoroughly purged with nitrogen, the flask is heated on an oil bath with stirring until the inside of the system reaches 75° C., thereby performing emulsion polymerization.

There is thus obtained a styrene-acrylic resin liquid dispersion (1) (solid content concentration: 42%) having a central particle diameter (volume average particle diameter) of the resin particle of 240 nm, a glass transition temperature of 52° C. and a weight average molecular weight Mw of 24,000.

Other acrylic resin liquid dispersions for adhering particle are prepared in the following manners.

—Preparation of Styrene-Acrylic Resin Liquid Dispersion (2)—

Styrene: 100 parts n-Butyl acrylate: 308 parts by weight

Acrylic acid: 4 parts by weight

Dodecane thiol: 3 parts by weight

Propanediol acrylate: 1.5 parts by weight

The foregoing components are mixed and dissolved, whereas a solution prepared by dissolving 2 parts by weight of an anionic surfactant, Dowfax (manufactured by The Dow Chemical Company) in 550 parts by weight of ion-exchanged water is accommodated in a flask; the foregoing mixed solution is added, dispersed and emulsified; and 50 parts of an ion-exchanged aqueous solution having 6 parts by weight of ammonium persulfate dissolved therein is added while gradually stirring and mixing for 10 minutes.

Subsequently, after the inside of the system is thoroughly purged with nitrogen, the flask is heated on an oil bath with stirring until the inside of the system reaches 70° C., thereby performing emulsion polymerization.

There is thus obtained a large styrene-acrylic resin liquid dispersion (2) (solid content concentration: 42%) having a central particle diameter (volume average particle diameter) of the resin particle of 345 nm, a glass transition temperature of 52° C. and a weight average molecular weight Mw of 66,000.

—Preparation of Styrene-Acrylic Resin Liquid Dispersion (3)—

Styrene: 50 parts n-Butyl acrylate: 358 parts by weight

Acrylic acid: 4 parts by weight

Dodecane thiol: 1.5 parts by weight

Propanediol acrylate: 1.5 parts by weight

The foregoing components are mixed and dissolved, whereas a solution prepared by dissolving 2 parts by weight of an anionic surfactant, Dowfax (manufactured by The Dow Chemical Company) in 550 parts by weight of ion-exchanged water is accommodated in a flask; the foregoing mixed solution is added, dispersed and emulsified; and 50 parts of an ion-exchanged aqueous solution having 6 parts by weight of ammonium persulfate dissolved therein is added while gradually stirring and mixing for 10 minutes.

Subsequently, after the inside of the system is thoroughly purged with nitrogen, the flask is heated on an oil bath with stirring until the inside of the system reaches 65° C., thereby performing emulsion polymerization.

There is thus obtained a styrene-acrylic resin liquid dispersion (3) (solid content concentration: 42%) having a central particle diameter (volume average particle diameter) of the resin particle of 470 nm, a glass transition temperature of 52° C. and a weight average molecular weight Mw of 69,000.

—Preparation of Styrene-Acrylic Resin Liquid Dispersion (4)—

Styrene: 296 parts n-Butyl acrylate: 92 parts by mass

Acrylic acid: 12 parts by mass

Dodecane thiol: 16 parts by mass

Carbon tetrabromide: 4 parts by mass

As all of the foregoing reagents, products of Wako Pure Chemical Industries, Ltd. are used.

A mixture obtained by mixing and dissolving the foregoing compounds is subjected to emulsion polymerization in a flask containing a solution obtained by dissolving 24 parts of a nonionic surfactant ((NONIPOL 400, manufactured by Sanyo Chemical Industries, Ltd.) and 40 parts by mass of an anionic surfactant (NEOGEN SC, manufactured by Dai-Ichi Kogyo Seiyaku Co., Ltd.) in 550 parts by mass of ion-exchanged water, and the reaction mixture is added to 50 parts by mass of ion-exchanged water having 16 parts by mass of ammonium persulfate (manufactured by Wako Pure Chemical Industries, Ltd.) while gradually mixing for 10 minutes. After purging with nitrogen, the flask is heated on an oil bath while stirring the inside of the flask until the content reaches 70° C., and the emulsion polymerization is continued for 5 hours as it is. As a result, a styrene-acrylic resin liquid dispersion (4) (solid content concentration: 42%) having a central particle diameter (volume average particle diameter) of the resin particle of 200 nm, a glass transition temperature of 58° C. and a weight average molecular weight Mw of 12,000 is obtained.

—Preparation of Styrene-Acrylic Resin Liquid Dispersion (5)—

Acrylic acid: 320 parts n-Butyl acrylate: 280 parts by mass

Dodecane thiol: 12 parts by mass glycidyl methacrylate: 8 parts by mass

As all of the foregoing reagents, products of Wako Pure Chemical Industries, Ltd. are used.

A mixture obtained by mixing and dissolving the foregoing compounds is added to a solution obtained by dissolving 48 parts of a nonionic surfactant ((NONIPOL 400, manufactured by Sanyo Chemical Industries, Ltd.) and 32 parts by mass of an anionic surfactant (NEOGEN SC, manufactured by Dai-Ichi Kogyo Seiyaku Co., Ltd.) in 610 parts by mass of ion-exchanged water; the mixture is dispersed and emulsified in a flask; 50 parts by mass of ion-exchanged water having 32 parts by mass of ammonium persulfate (manufactured by Wako Pure Chemical Industries, Ltd.) was added thereto while gradually mixing for 10 minutes, followed by purging with nitrogen at a rate of 0.1 L/min for 20 minutes. Thereafter, the flask is heated on an oil bath while stirring the inside of the flask until the content reaches 70° C., and the emulsion polymerization is continued for 5 hours as it is. As a result, a styrene-acrylic resin liquid dispersion (5) (solid content concentration: 42%) having a central particle diameter (volume average particle diameter) of the resin particle of 200 nm, a glass transition temperature of 63° C. and a weight average molecular weight Mw of 42,000 is obtained.

—Cyan Pigment Liquid Dispersion—

Cyan pigment (C.I. Pigment Blue 15:3 (copper phthalocyanine), manufactured by Dainichiseika Color & Chemicals Mfg. Co., Ltd.): 100 parts Anionic surfactant (NEOGEN R, manufactured by Dai-Ichi Kogyo Seiyaku Co., Ltd.): 1.5 parts Ion-exchanged water: 400 parts The foregoing components are mixed and dissolved, and the solution is dispersed for about one hour using a high-pressure counter collision disperser, MULTIMIZER (HJP30006, manufactured by Sugino Machine Limited), thereby preparing a coloring agent particle liquid dispersion. A cyan pigment liquid dispersion has a volume average particle diameter of cyan pigment particle of 0.16 μm and a solid content concentration of 20%.

—Release Agent Liquid Dispersion—

Paraffin wax (HNP-9, manufactured by Nippon Seiro Co., Ltd., melting temperature: 75° C.): 50 parts Anionic surfactant (NEOGEN RK, manufactured by Dai-Ichi Kogyo Seiyaku Co., Ltd.): 0.5 parts Ion-exchanged water: 200 parts The foregoing components are mixed and heated at 95° C., and the mixture is dispersed using a homogenizer (ULTRA TURRAX T50, manufactured by IKA Japan K.K.) and then subjected to a dispersing treatment using a Manton-Gaulin high-pressure homogenizer (manufactured by Gaulin, Inc.), thereby preparing a release agent liquid dispersion (solid content concentration: 20%) in which a release agent particle having a volume average particle diameter of 0.23 μm is dispersed.

Example 1

A toner (1) is prepared in the following manner.

A toner (1) is manufactured by the aggregation method using a core composition for forming an aggregate, a shell composition for adhering particle and an adhering particle composition, each of which is described below.

Core Composition for Forming an Aggregate

Ion-exchanged water: 650 parts

Polyester resin liquid dispersion (1): 367 parts

Cyan pigment liquid dispersion: 50 parts

Release agent liquid dispersion: 100 parts

Anionic surfactant (NEOGEN RK, manufactured by Dai-Ichi Kogyo Seiyaku Co., Ltd., 20% by weight): 5.5 parts Shell Composition for Adhering Particle Polyester resin liquid dispersion (1): 100 parts Anionic surfactant (NEOGEN RK, manufactured by Dai-Ichi Kogyo Seiyaku Co., Ltd., 20% by weight): 3.0 parts Adhering Particle Composition Polyester resin liquid dispersion (1): 100 parts Anionic surfactant (NEOGEN RK, manufactured by Dai-Ichi Kogyo Seiyaku Co., Ltd., 20% by weight): 3.0 parts The foregoing core composition is charged in a 3-liter reactor equipped with a thermometer, a pH meter and a stirrer and kept at a temperature of 30° C. at a stirring rotation number of 150 rpm for 30 minutes while controlling the temperature from the outside using a mantle heater.

A PAC aqueous solution having 1.0 part of PAC (a 30% powder product, manufactured by Oji Paper Co., Ltd.) dissolved in 10 parts of ion-exchanged water while dispersing using a homogenizer (ULTRA TURRAX T50, manufactured by IKA Japan K.K.). Thereafter, a 0.3 N nitric acid aqueous solution is added, thereby adjusting a pH in the aggregating step at 3.5. The temperature is increased to 50° C., and the particle diameter is measured using a Coulter Multisizer II (aperture diameter: 50 μm, manufactured by Heckman Coulter Inc.), thereby preparing an aggregate having a volume average particle size of 5.0 μm. Thereafter, the pH is dropped to 2.5.

Subsequently, the shell composition for adhering particle having a pH adjusted at 2.5 is additionally added, and after elapsing 5 minutes, the adhering particle composition having a pH adjusted at 4.3 is additionally added, thereby adhering the organic resin particle onto the surface of the aggregate (shell structure).

Subsequently, 40 parts of a 10% by weight NTA (nitrilotriacetic acid) metal salt aqueous solution (CHELEST 70, manufactured by Chelest Corporation) is added, and the pH is then adjusted at 9.0 using a 1N sodium hydroxide aqueous solution. Thereafter, the temperature is increased to 90° C. at a rate of 0.05° C./min, and after keeping at 90° C. for 3 hours, the resultant is cooled and filtered to obtain a coarse toner particle. Furthermore, re-dispersing in ion-exchanged water and filtration are repeated, and washing is performed until an electrical conductivity of the filtrate reaches not more than 20 μS/cm, followed by drying in vacuo in an oven at 40° C. for 5 hours to obtain a toner particle.

100 parts by weight of the obtained toner particle is mixed and blended with 1.5 parts by weight of hydrophobic silica (RY50, manufactured by Nippon Aerosil Co., Ltd.) and 1.0 part by weight of hydrophobic titanium oxide (T805, manufactured by Nippon Aerosil Co., Ltd.) at 10,000 rpm for 30 seconds using a sample mill. Thereafter, the resultant is sieved using a vibrating screen with an opening of 45 μm to prepare a toner (1). A volume average particle diameter of the obtained toner (I) is 5.9 μm.

Other characteristic values regarding the shape of the toner (1) are described in Table 1.

Example 2

A toner (2) is prepared in the same manner as in Example 1, except that in Example 1, the polyester resin liquid dispersion (2) is used in place of the polyester resin liquid dispersion (1) used as the adhering particle composition. A volume average particle diameter of the obtained toner is 5.8 μm.

Example 3

A toner (3) is prepared in the same manner as in Example 1, except that in Example 1, the polyester resin liquid dispersion (3) is used in place of the polyester resin liquid dispersion (1) used as the adhering particle composition. A volume average particle diameter of the obtained toner is 5.7 μm.

Example 4

A toner (4) is prepared in the same manner as in Example 2, except that in Example 2, the amount of the polyester resin liquid dispersion (1) used as the shell composition for adhering particle is changed to 133 parts, and similarly, the amount of the polyester resin liquid dispersion (2) used as the adhering particle composition is changed to 67 parts. A volume average particle diameter of the obtained toner is 5.8 μm.

Example 5

A toner (5) is prepared in the same manner as in Example 2, except that in Example 2, the amount of the polyester resin liquid dispersion (1) used as the shell composition for adhering particle is changed to 33 parts, and similarly, the amount of the polyester resin liquid dispersion (2) used as the adhering particle composition is changed to 167 parts. A volume average particle diameter of the obtained toner is 5.7 μm.

Example 6

A toner (6) is prepared in the same manner as in Example 4, except that in Example 4, the polyester resin liquid dispersion (3) is used in place of the polyester resin liquid dispersion (2) used as the adhering particle composition. A volume average particle diameter of the obtained toner is 5.8 μm.

Example 7

A toner (7) is prepared in the same manner as in Example 5, except that in Example 5, the polyester resin liquid dispersion (3) is used in place of the polyester resin liquid dispersion (2) used as the adhering particle composition. A volume average particle diameter of the obtained toner is 5.7 μm.

Example 8

A toner (8) is prepared in the same manner as in Example 1, except that in Example 1, 72 parts of the styrene-acrylic resin liquid dispersion (1) is used in place of 100 parts of the polyester resin liquid dispersion (1) used as the adhering particle composition. A volume average particle diameter of the obtained toner is 5.8 μm.

Example 9

A toner (9) is prepared in the same manner as in Example 1, except that in Example 1, 72 parts of the styrene-acrylic resin liquid dispersion (2) is used in place of 100 parts of the polyester resin liquid dispersion (1) used as the adhering particle composition. A volume average particle diameter of the obtained toner is 5.7 μm.

Example 10

A toner (10) is prepared in the same manner as in Example 1, except that in Example 1, 72 parts of the styrene-acrylic resin liquid dispersion (3) is used in place of 100 parts of the polyester resin liquid dispersion (1) used as the adhering particle composition. A volume average particle diameter of the obtained toner is 5.9 μm.

Example 11

Ion-exchanged water: 750 parts
Styrene-acrylic resin liquid dispersion (1): 262 parts
Cyan pigment liquid dispersion: 50 parts
Release agent liquid dispersion: 100 parts
Aluminum sulfate (manufactured by Wako Pure Chemical Industries, Ltd.): 1.5 parts The foregoing components are charged in a 3-liter reactor and mixed and dispersed using a homogenizer (ULTRA TURRAX T50, manufactured by IKA Japan K.K.), followed by heating to 50° C. with stirring by a mantle heater. After keeping at 50° C. for 30 minutes, the particle diameter is measured using a Coulter Multisizer II (aperture diameter: 50 μm, manufactured by Beckman Coulter Inc.), thereby preparing an aggregate having a volume average particle size of 4.8 μm. At that time, the pH is 2.0.

Furthermore, 72 parts of the styrene-acrylic resin liquid dispersion (1) having a pH adjusted at 2.5 is additionally added, and after elapsing 5 minutes, 72 parts of the styrene-acrylic resin liquid dispersion (2) having a pH adjusted at 4.3 is additionally added, thereby adhering the organic resin particle onto the surface of the aggregate (shell structure). The resultant is further kept at 50° C. for 30 minutes to prepare an aggregate, a liquid dispersion containing this aggregate particle and 1 N sodium hydroxide are added to adjust the system at a pH of 7.0. Thereafter, a stainless steel-made flask is hermetically sealed and heated to 90° C. while continuing stirring using a magnetic seal, and after keeping for 4 hours, the resultant is cooled and filtered to obtain a coarse toner particle. Furthermore, re-dispersing in ion-exchanged water and filtration are repeated, and washing is performed until an electrical conductivity of the filtrate reaches not more than 20 μS/cm, followed by drying in vacuo in an oven at 40° C. for 5 hours to obtain a toner particle.

100 parts by weight of the obtained toner particle is mixed and blended with 1.5 parts by weight of hydrophobic silica (RY50, manufactured by Nippon Aerosil Co., Ltd.) and 1.0 part by weight of hydrophobic titanium oxide (T805, manufactured by Nippon Aerosil Co., Ltd.) at 10,000 rpm for 30 seconds using a sample mill. Thereafter, the resultant is sieved using a vibrating screen with an opening of 45 μm to prepare a toner (11). A volume average particle diameter of the obtained toner (11) is 5.8 μm.

Example 12

A toner (12) is prepared in the same manner as in Example 11, except that in Example 11, the styrene-acrylic resin liquid dispersion (3) is used in place of the styrene-acrylic resin liquid dispersion (2). A volume average particle diameter of the obtained toner is 5.8 μm.

Comparative Example 1

A toner (13) is prepared in the same manner as in Example 2, except that in Example 2, the amount of the polyester resin liquid dispersion (1) used as the shell composition for adhering particle is changed to 167 parts, and similarly, the amount of the polyester resin liquid dispersion (2) used as the adhering particle composition is changed to 33 parts. A volume average particle diameter of the obtained toner is 5.8 μm.

Comparative Example 2

A toner (14) is prepared in the same manner as in Example 3, except that in Example 3, the amount of the polyester resin liquid dispersion (1) used as the shell composition for adhering particle is changed to 167 parts, and similarly, the amount of the polyester resin liquid dispersion (3) used as the adhering particle composition is changed to 33 parts. A volume average particle diameter of the obtained toner is 5.7 μm.

Comparative Example 3

Core Composition for Forming an Aggregate

Ion-exchanged water: 460 parts
Polyester resin liquid dispersion (1): 367 parts
Cyan pigment liquid dispersion: 50 parts
Release agent liquid dispersion: 100 parts
Anionic surfactant (NEOGEN RK, manufactured by Dai-Ichi Kogyo Seiyaku Co., Ltd., 20% by weight): 5.5 parts
Shell Composition for Adhering Particle
Polyester resin liquid dispersion (1): 33 parts
Polyester resin liquid dispersion (2): 167 parts
Anionic surfactant (NEOGEN RK, manufactured by Dai-Ichi Kogyo Seiyaku Co., Ltd., 20% by weight): 6.0 parts The foregoing core composition is charged in a 3-liter reactor equipped with a thermometer, a pH meter and a stirrer and kept at a temperature of 30° C. at a stirring rotation number of 150 rpm for 30 minutes while controlling the temperature from the outside using a mantle heater.

A PAC aqueous solution having 1.0 part of PAC (a 30% powder product, manufactured by Oji Paper Co., Ltd.) dissolved in 10 parts of ion-exchanged water while dispersing using a homogenizer (ULTRA TURRAX T50, manufactured by IKA Japan K.K.). Thereafter, a 0.3 N nitric acid aqueous solution is added, thereby adjusting a pH in the aggregating step at 3.5. The temperature is increased to 50° C., and the particle diameter is measured using a Coulter Multisizer II (aperture diameter: 50 μm, manufactured by Beckman Coulter Inc.), thereby preparing an aggregate having a volume average particle size of 5.0 μm. Thereafter, the pH is dropped to 2.5.

Subsequently, the shell composition for adhering particle having a pH adjusted at 2.5 is additionally added, thereby adhering the organic resin particle onto the surface of the aggregate (shell structure).

Subsequently, 40 parts of a 10% by weight NTA (nitrilotriacetic acid) metal salt aqueous solution (CHELEST 70, manufactured by Chelest Corporation) is added, and the pH is then adjusted at 9.0 using a 1 N sodium hydroxide aqueous solution. Thereafter, the temperature is increased to 90° C. at a rate of 0.05° C./min, and after keeping at 90° C. for 3 hours, the resultant is cooled and filtered to obtain a coarse toner particle. Furthermore, re-dispersing in ion-exchanged water and filtration are repeated, and washing is performed until an electrical conductivity of the filtrate reaches not more than 20 μS/cm, followed by drying in vacuo in an oven at 40° C. for 5 hours to obtain a toner particle.

100 parts by weight of the obtained toner particle is mixed and blended with 1.5 parts by weight of hydrophobic silica (RY50, manufactured by Nippon Aerosil Co., Ltd.) and 1.0 part by weight of hydrophobic titanium oxide (T805, manufactured by Nippon Aerosil Co., Ltd.) at 10,000 rpm for 30 seconds using a sample mill. Thereafter, the resultant is sieved using a vibrating screen with an opening of 45 μm to prepare a toner (15). A volume average particle diameter of the obtained toner (15) is 6.0 μm.

Comparative Example 4

A toner (16) is prepared in the same manner as in Comparative Example 3, except that in Comparative Example 3, the polyester resin liquid dispersion (3) is used in place of the polyester resin liquid dispersion (2) used as the shell composition for adhering particle. A volume average particle diameter of the obtained toner is 5.8 μm.

Comparative Example 5

Ion-exchanged water: 900 parts
Styrene-acrylic resin liquid dispersion (4): 305 parts
Cyan pigment liquid dispersion: 80 parts
Release agent liquid dispersion: 150 parts
Aluminum sulfate (manufactured by Wako Pure Chemical Industries, Ltd.): 1.5 parts The foregoing components are charged in a 3-liter reactor and mixed and dispersed using a homogenizer (ULTRA TURRAX T50, manufactured by IKA Japan K.K.), followed by heating to 50° C. with stirring by a mantle heater. After keeping at 50° C. for 30 minutes, the particle diameter is measured using a Coulter Multisizer II (aperture diameter: 50 μm, manufactured by Beckman Coulter Inc.), thereby preparing an aggregate having a volume average particle size of 4.8 μm.

Furthermore, a mixture of 30 parts of the styrene-acrylic resin liquid dispersion (4) and 20 parts of the styrene-acrylic resin liquid dispersion (5) is additionally added, and the mixture is further kept at 50° C. for 30 minutes to prepare an aggregate. A liquid dispersion containing this aggregate particle and 1 N sodium hydroxide are added to adjust the system at a pH of 7.0. Thereafter, a stainless steel-made flask is hermetically sealed and heated to 90° C. while continuing stirring using a magnetic seal, and after keeping for 4 hours, the resultant is cooled and filtered to obtain a coarse toner particle. Furthermore, re-dispersing in ion-exchanged water and filtration are repeated, and washing is performed until an electrical conductivity of the filtrate reaches not more than 20 μS/cm, followed by drying in vacuo in an oven at 40° C. for 5 hours to obtain a toner particle.

100 parts by weight of the obtained toner particle is mixed and blended with 1.5 parts by weight of hydrophobic silica (RY50, manufactured by Nippon Aerosil Co., Ltd.) and 1.0 part by weight of hydrophobic titanium oxide (T805, manufactured by Nippon Aerosil Co., Ltd.) at 10,000 rpm for 30 seconds using a sample mill. Thereafter, the resultant is sieved using a vibrating screen with an opening of 45 μm to prepare a toner (17). A volume average particle diameter of the obtained toner (17) is 5.8 μm.

<Condition for Removing External Additive>

As for the measurement of an external additive adhesive strength, an ultrasonic vibration (output: 20 W, frequency: 20 kHz) is applied to a liquid dispersion prepared by dispersing the toner in a triton solution (0.2% by weight aqueous solution of polyethylene octylphenyl ether, manufactured by Wako Chemical Industries, Ltd.) for 5 minutes, followed by filtration to obtain a toner matrix particle from which the external additive is removed. As a result of confirming an electron microscopic photograph, the toner matrix particle in which the external additive is once adhered and then removed is substantially equal to that before adhering, and a value of a ratio X of peripheral length (PM)/circle-corresponding diameter (D) is identical.

<Evaluation Method of Transfer Efficiency>

A solid batch of 5 cm×2 cm is developed in a high-temperature high-humidity environment (at 30° C. and 80% RH), a developed toner image on the photoreceptor surface is transferred utilizing adhesiveness on the tape surface, and its weight (W1) is measured. Also, similarly, a developed toner image on the photoreceptor surface obtained by similarly developing a solid batch is visually evaluated with respect to a degree of unevenness. Subsequently, the same developed toner image is transferred onto the surface of paper (J Paper, manufactured by Fuji Xerox Office Supply Co., Ltd.), and a weight (W2) of the transferred image is measured. A transfer efficiency is determined therefrom according to the following expression, thereby evaluating the transferability.

$$\text{Transfer efficiency}(\%)=(W2/W1)\times 100$$

Also, the developability is evaluated by the weight W1 at that time.

—Evaluation Criteria of Developability—

A: W1 is 4.5 g/m$^2$ or more.

B: W1 is 4.0 g/m$^2$ or more and less than 4.5 g/m$^2$.

C: W1 is less than 4.0 g/m$^2$.

—Evaluation Criteria of Transferability (Transfer Efficiency)—

A: The transfer efficiency is 95% or more.

B: The transfer efficiency is 90% or more and less than 95%.

C: The transfer efficiency is 85% or more and less than 90%.

D: The transfer efficiency is less than 85%.

<Evaluation Method of Cleaning Properties>

In an environmental chamber at room temperature of 28° C. and a humidity of 90%, the obtained developer is filled in a developing unit of a modified machine of DocuCenter Color 450a (manufactured by Fuji Xerox Co., Ltd.) of a quadruplet tandem system shown in FIG. 2 (modified such that a process speed of the developing unit is controlled by an external power source control), a charge amount of the toner in a tip of 10 cm of the image on color paper (J Paper, manufactured by Fuji Xerox Co., Ltd.) is adjusted to 6 g/m$^2$, and the image formation is continuously performed on 10,000 sheets at a peripheral speed of the developer holding member of 2,000 mm/sec. A deposit on the photoreceptor is visually confirmed every image formation of 2,000 sheets, and the evaluation is made according to the following criteria.

—Evaluation Criteria of Cleaning Properties—

A: A deposit is not confirmed on the photoreceptor up to 10,000 sheets.

B: A deposit is not confirmed on the photoreceptor up to 4,000 sheets.

C: A streak-shaped deposit is confirmed at a point of time of the image formation of 4,000 sheets. However, such is not on a problematic level from the standpoint of practical use.

D: A deposit is confirmed substantially over an entire region of the photoreceptor.

<Measurement Method of the Circumstance of Irregularity>

The toner matrix particle is enlarged with a magnification of 10,000 using S4800 (a scanning electron microscope, manufactured by Hitachi High-Technologies Corporation) such that the whole of the toner can be observed, thereby obtaining a toner image. Subsequently, the image of the whole of the toner is subjected to image analysis using LUZEX, manufactured by Nireco Corporation, thereby determining a PM value (peripheral length) of the toner particle. Subsequently, a toner particle diameter $D_{50v}$ is measured, and a ratio X is determined according to the following expression.

$$\text{Ratio } X=(PM \text{ value(peripheral length)})/(\text{Toner circle-corresponding diameter } D_{50v})$$

In the case of a true circle, this ratio X is close to 3.14 that is the ratio of the circumference of a circle to its diameter; whereas when the ratio X is large, it is meant that irregularities of the toner shape are large.

TABLE 1

| | Toner No. | Kind of binder resin | Kind of adhering particle | Addition amount of adhering particle [%] | Ratio X | Particle diameter of adhering particle [nm] |
|---|---|---|---|---|---|---|
| Example 1 | Toner (1) | Polyester resin liquid dispersion (1) | Polyester resin liquid dispersion (1) | 15 | 3.68 | 160 |
| Example 2 | Toner (2) | Polyester resin liquid dispersion (1) | Polyester resin liquid dispersion (2) | 15 | 3.75 | 320 |
| Example 3 | Toner (3) | Polyester resin liquid dispersion (1) | Polyester resin liquid dispersion (3) | 15 | 4.42 | 470 |
| Example 4 | Toner (4) | Polyester resin liquid dispersion (1) | Polyester resin liquid dispersion (2) | 10 | 3.62 | 320 |
| Example 5 | Toner (5) | Polyester resin liquid dispersion (1) | Polyester resin liquid dispersion (2) | 25 | 3.93 | 320 |
| Example 6 | Toner (6) | Polyester resin liquid dispersion (1) | Polyester resin liquid dispersion (3) | 10 | 3.65 | 470 |
| Example 7 | Toner (7) | Polyester resin liquid dispersion (1) | Polyester resin liquid dispersion (3) | 25 | 4.83 | 470 |
| Example 8 | Toner (8) | Polyester resin liquid dispersion (1) | Styrene-acrylic resin liquid dispersion (1) | 15 | 3.72 | 240 |
| Example 9 | Toner (9) | Polyester resin liquid dispersion (1) | Styrene-acrylic resin liquid dispersion (2) | 15 | 3.88 | 345 |
| Example 10 | Toner (10) | Polyester resin liquid dispersion (1) | Styrene-acrylic resin liquid dispersion (3) | 15 | 4.63 | 470 |
| Example 11 | Toner (11) | Styrene-acrylic resin liquid dispersion (1) | Styrene-acrylic resin liquid dispersion (2) | 15 | 3.76 | 345 |
| Example 12 | Toner (12) | Styrene-acrylic resin liquid dispersion (1) | Styrene-acrylic resin liquid dispersion (3) | 15 | 4.52 | 470 |
| Comparative Example 1 | Toner (13) | Polyester resin liquid dispersion (1) | Polyester resin liquid dispersion (2) | 5 | 3.48 | 320 |
| Comparative Example 2 | Toner (14) | Polyester resin liquid dispersion (1) | Polyester resin liquid dispersion (3) | 5 | 3.52 | 470 |
| Comparative Example 3 | Toner (15) | Polyester resin liquid dispersion (1) | Polyester resin liquid dispersion (2) | 25 | 3.46 | 320 |
| Comparative Example 4 | Toner (16) | Polyester resin liquid dispersion (1) | Polyester resin liquid dispersion (3) | 25 | 3.55 | 470 |
| Comparative Example 5 | Toner (17) | Styrene-acrylic resin liquid dispersion (4) | Polyester resin liquid dispersion (5) | 4 | 3.35 | 200 |

TABLE 1-continued

| | Projected area of adhering particle/matrix particle [%] | Adhering method | Adhering particle diameter/matrix particle diameter | Particle diameter [μm] | Shape factor SF1 | Developability | Transferability | Cleaning properties |
|---|---|---|---|---|---|---|---|---|
| Example 1 | 36 | Two-stage | 0.027 | 5.9 | 118 | A | B | B |
| Example 2 | 44 | Two-stage | 0.055 | 5.8 | 120 | A | A | A |
| Example 3 | 51 | Two-stage | 0.082 | 5.7 | 123 | A | A | A |
| Example 4 | 24 | Two-stage | 0.055 | 5.8 | 120 | A | B | B |
| Example 5 | 56 | Two-stage | 0.056 | 5.7 | 122 | A | A | A |
| Example 6 | 34 | Two-stage | 0.081 | 5.8 | 120 | A | A | B |
| Example 7 | 73 | Two-stage | 0.082 | 5.7 | 124 | A | A | A |
| Example 8 | 45 | Two-stage | 0.041 | 5.8 | 120 | A | A | A |
| Example 9 | 47 | Two-stage | 0.061 | 5.7 | 121 | A | A | A |
| Example 10 | 58 | Two-stage | 0.080 | 5.9 | 123 | A | A | A |
| Example 11 | 43 | Two-stage | 0.059 | 5.8 | 120 | A | A | A |
| Example 12 | 53 | Two-stage | 0.081 | 5.8 | 123 | A | A | A |
| Comparative Example 1 | 18 | Two-stage | 0.055 | 5.8 | 118 | C | C | D |
| Comparative Example 2 | 17 | Two-stage | 0.082 | 5.7 | 117 | C | C | C |
| Comparative Example 3 | 12 | Same time | 0.053 | 6.0 | 116 | C | C | D |
| Comparative Example 4 | 18 | Same time | 0.081 | 5.8 | 118 | B | C | C |
| Comparative Example 5 | 5 | Same time | 0.034 | 5.8 | 115 | C | D | D |

While the present invention has been shown and described with reference to certain exemplary embodiments thereat it will be understood by those skilled in the art that various changes modifications may be made therein without departing from the spirit and scope of the present invention as defined by the appended claims.

What is claimed is:

1. An electrostatic image developing toner comprising:

a toner matrix particle having an adhering particle adhered onto the surface of a central particle, wherein a volume average value of a ratio X of a peripheral length PM of the toner matrix particle to a circle-corresponding diameter D of the toner matrix particle is from 3.6 to 5.0, a volume average value of a particle diameter of the toner matrix particle is from 2 μm to 8 μm, a volume average value of a particle diameter of the adhering particle is from 100 nm to 500 nm, and the adhering particle is embedded into the surface of the central particle at a depth of not more than ¼ of the diameter of the adhering particle.

2. The electrostatic image developing toner according to claim 1, wherein the central particle comprises a binder resin, and the binder resin is a polyester resin or an acrylic resin.

3. The electrostatic image developing toner according to claim 1, wherein the binder resin has a softening temperature of from 90° C. to 150° C.

4. The electrostatic image developing toner according to claim 1, wherein the binder resin has a glass transition temperature of from 50° C. to 75° C.

5. The electrostatic image developing toner according to claim 1, wherein the binder resin has a weight average molecular weight of from 8,000 to 150,000.

6. The electrostatic image developing toner according to claim 1, wherein the binder resin has an acid number of from 5 mg-KOH/g to 30 mg-KOH/g.

7. The electrostatic image developing toner according to claim 1, wherein the adhering particle is an organic resin particle.

8. The electrostatic image developing toner according to claim 1, wherein a number average value of a proportion of a projected area of the adhering particle to a total projected area of the toner matrix particle by SEM observation is from 20% to 80%.

9. The electrostatic image developing toner according to claim 1, wherein a circle-corresponding diameter of the toner matrix particle is from 2 μm to 8 μm.

10. The electrostatic image developing toner according to claim 1, wherein the central particle further comprises a release agent, and the release agent is melted at any temperature of from 70° C. to 140° C.

11. An electrostatic image developer comprising:

the electrostatic image developing toner according to claim 1; and a carrier.

12. The electrostatic image developer according to claim 11, wherein the carrier is coated with a coating resin, and the coating resin comprises a resin particle and/or a conductive particle in a dispersion state.

13. The electrostatic image developer according to claim 12, wherein the coating resin comprises a nitrogen-containing resin.

14. The electrostatic image developer according to claim 12, wherein the conductive particle is a carbon black having a DBP oil absorption of from 50 mL/100 g to 250 mL/100 g.

15. The electrostatic image developer according to claim 11, wherein an electrical resistance of the carrier in a magnetic brush state in an electric field of $10^4$ V/cm is from $10^8$ Ωcm to $10^{13}$ Ωcm.

16. A method for forming an image comprising:

charging an image holding member;

forming an electrostatic latent image on the surface of the image holding member;

developing the electrostatic latent image formed on the surface of the image holding member with the electrostatic image developer according to claim 11;

transferring the toner image formed on the surface of the image holding member onto the surface of a transfer-receiving material; and fixing the transferred toner image onto a medium to be recorded.

17. The method for forming an image according to claim 16, wherein a most surficial layer of a heating member which is used in the fixing step has surface energy of from $30\times10^{-3}$ N/m to $3{,}000\times10^{-3}$ N.

18. The electrostatic image developing toner according to claim 1, wherein an addition amount of the adhering particle is from 10% to 40%.

* * * * *